US007881623B2

(12) United States Patent
Yamaguchi

(10) Patent No.: US 7,881,623 B2
(45) Date of Patent: Feb. 1, 2011

(54) IMAGE FORMING APPARATUS WITH DEVELOPER SUPPLY CONTROL

(75) Inventor: Seiji Yamaguchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 87 days.

(21) Appl. No.: 12/200,152

(22) Filed: Aug. 28, 2008

(65) Prior Publication Data

US 2009/0060533 A1 Mar. 5, 2009

(30) Foreign Application Priority Data

Aug. 29, 2007 (JP) ..... 2007-223281
Aug. 22, 2008 (JP) ..... 2008-214709

(51) Int. Cl.
*G03G 15/08* (2006.01)

(52) U.S. Cl. ..... 399/27; 399/258

(58) Field of Classification Search ..... 399/27, 399/258

See application file for complete search history.

(56) References Cited

U.S. PATENT DOCUMENTS

| | | | | |
|---|---|---|---|---|
| 6,381,431 | B1 | 4/2002 | Kinoshita et al. | 399/175 |
| 6,640,060 | B2 | 10/2003 | Yamaguchi et al. | 399/27 |
| 6,708,007 | B2 | 3/2004 | Yamaguchi | 399/30 |
| 6,892,037 | B2 | 5/2005 | Ohkubo | 399/27 |
| 7,003,233 | B2 | 2/2006 | Matsuda et al. | 399/27 |
| 2001/0055497 | A1* | 12/2001 | Hasegawa et al. | 399/58 |
| 2003/0072576 | A1* | 4/2003 | Rodriguez | 399/27 |
| 2005/0117920 | A1 | 6/2005 | Ogata et al. | 399/27 |
| 2006/0263106 | A1* | 11/2006 | Yamaguchi et al. | 399/27 |
| 2008/0031644 | A1* | 2/2008 | Kin et al. | 399/27 |
| 2008/0138118 | A1 | 6/2008 | Imamura et al. | 399/254 |

FOREIGN PATENT DOCUMENTS

| | | |
|---|---|---|
| JP | 10-20640 A | 1/1998 |
| JP | 2002-40776 A | 2/2002 |

* cited by examiner

*Primary Examiner*—Sophia S Chen
(74) *Attorney, Agent, or Firm*—Fitzpatrick, Cella, Harper & Scinto

(57) ABSTRACT

An image forming apparatus includes a developing device for developing an electrostatic image with a developer; a developer amount detecting device for detecting an amount of a developer in the developing device; a developer consumption amount calculating device for calculating a consumption amount of the developer on the basis of image information of the electrostatic image; a developer supplying device for supplying the developer to the developing device; a control device for controlling a developer supply operation to the developing device by the developer supplying device, wherein the control device controls the developer supply device to supply a predetermined amount of the developer every time an integrated value of the consumption amount of the developer exceeds a supply threshold, and corrects the supply threshold on the basis of information relating to an amount of the developer in the developing device detected by the developer amount detecting device.

12 Claims, 10 Drawing Sheets

IMAGE FORMING APPARATUS WITH DEVELOPER SUPPLY CONTROL

FIELD OF THE INVENTION AND RELATED ART

The present invention relates to an image forming apparatus, such as a copying machine, a printer, a facsimile machine, etc., which uses an electrophotographic image forming method or an electrostatic recording method to form an image by developing, with the use of developer, an electrostatic image formed on an image bearing member.

The typical image forming operation of a conventional image forming apparatus is as follows: First an electrostatic image is formed on an electrophotographic photosensitive member (photosensitive member), which is an image bearing member. Then, the electrostatic latent image is developed into a visible image, that is, an image formed of the toner in developer, with the use of a developing apparatus. Thereafter, the image formed of toner (which hereafter may be referred to simply as toner image) on the photosensitive member is transferred onto transfer medium, such as a sheet of recording paper, which is a medium onto which a toner image is transferred. Then, the toner image on the transfer medium is fixed to the transfer medium with the use of heater, pressure, etc. Then, the recording medium having the fixed toner image is outputted from the image forming apparatus.

A developing apparatus, with which the image forming apparatus is provided, has a developer container, which contains toner. The toner in the developer in developer container is consumed by image formation. Thus, a developer container has to be periodically replenished with toner. Some image forming apparatuses are known to be structured so that as the toner in their developer container is consumed, the developer container is supplied with the toner from a toner supplying apparatus, which is a developer supplying member. Further, some image forming apparatuses, and the toner supply containers which are compatible therewith, are known to be structured so that the toner supply containers are removable mountable in the main assembly of the image forming apparatus, making it possible to replace any of the toner supply containers in the main assembly, with a brand-new toner supply container, as the former becomes depleted of the toner.

Generally, the amount by which toner is supplied to a developing apparatus from a toner supplying apparatus is controlled by controlling the length of time the toner supplying apparatus is operated. More specifically, as a toner amount detecting means detects that the toner in the developer container has reduced in quantity, it outputs to the toner supplying apparatus a request for toner supply. Then, the toner supplying member, such as a toner supply roller, with which the toner supplying apparatus is provided, is driven for a preset length of time (or rotated by preset number of times), to supply the developer container with a preset amount of toner from the toner supplying apparatus.

Patent Document 1 discloses a developing apparatus designed as follows: The toner level in the development chamber is detected by the toner level detecting means. Then, the toner is supplied from the toner hopper to the developing apparatus by a preset amount into the development chamber.

Patent Document 2 discloses a developing apparatus designed as follows: The toner level in the developing apparatus is detected by the toner level detecting means. Then, toner is supplied from the toner supply hopper to the developing apparatus by an amount which is proportional to the detected toner lever so that the toner level in the developing apparatus remains within a preset range.

Generally, a toner supplying apparatus is designed so that the quantity (length of time, for example) of the operation of the toner supplying apparatus is proportional to the amount by which toner is discharged from the toner supplying apparatus. Therefore, the cumulative amount of toner discharged from the toner supplying apparatus can be obtained by calculating the cumulative quantity (length of time) of the operation of the toner supplying apparatus.

This fact was taken into consideration when some image forming apparatuses were designed. That is, some image forming apparatuses are designed so that the amount of the residual toner in a toner supply container is determined (estimated) based on the cumulative amount of the toner discharged from the toner supplying apparatus, which is calculated from the cumulative quantity (length of time) of the operation of the toner supplying apparatus.

Generally, an image forming apparatus is designed based on the presumption that the quantity (length of time, for example) of the operation of the toner supplying apparatus is proportional to the amount by which toner is discharged from the toner supplying apparatus, for example, a presumption that a single full rotation of the toner supply roller of the toner supplying apparatus causes the toner in the toner supplying apparatus to be discharged by 0.5 g.

However, there are many cases where the quantity of the operation of the toner supplying apparatus, for example, the number of revolutions of the toner supply roller (or length of time toner supply roller is rotated) is not strictly proportionate to the amount by which toner is discharged from the toner supplying apparatus. That is, while toner is conveyed by the supply roller or the like of the toner supplying apparatus, it is subtly affected in density by various factors, for example, the temperature and humidity of the environment in which an image forming apparatus is used, differences in properties among various toners, amount of the toner in the toner supply container, number of times the supply roller needs to be rotated per toner supplying operation, etc. In other words, the relationship between the quantity of the operation of the toner supplying apparatus and the amount by which toner is discharged from the toner supplying apparatus subtly changes.

FIG. 12 is a graph showing the relationship between the amount (%) of the toner remaining in a toner supplying apparatus, and the amount by which toner is discharged from the toner supplying apparatus per rotation of the toner supply roller. It is assumed that the apparatuses A, B, and C, to which FIG. 12 concerns, are the same in specifications, and also, that they all are 500 mg in the amount by which toner is discharged therefrom per rotation of their toner supply roller. In reality, however, they are different in the amount by which toner is discharged from a toner supplying apparatus per rotation of the toner supply roller.

FIG. 13 shows an example of the change in the amount of the toner in the developer container, which occurs with the increase in the cumulative number of image outputs. Hereafter, the estimated amount by which toner is to be supplied to the developer container of a developing apparatus by a toner supplying apparatus per operation of the toner supplying apparatus, and which can be estimated based on the design of an image forming apparatus, will be referred to as the "estimated amount", whereas the actual amount by which toner is supplied from a toner supplying apparatus per toner supplying operation of the toner supplying apparatus will be referred to as the "actual amount".

Referring to FIG. 13, in a case where the "estimated amount" equal to the "actual amount", toner is supplied to the developing apparatus by an amount equal to the requested amount. Therefore, the amount of the toner in the developer container does not change. In a case where the "estimated amount" is smaller than "actual amount", toner is supplied to the developer container by an amount greater than the requested amount, gradually increasing the amount of the toner in the developer container. On the other hand, if "estimated amount" is greater than the "actual amount", the amount of the toner in the developer container gradually reduces.

That is, if the "estimated amount" is different from the "actual amount", toner is supplied by an excessive or insufficient amount, and therefore, the amount of the toner in the developer container changes.

In the case of an image forming apparatus designed so that it calculates the amount of the toner remaining in its toner supply container, based on the cumulative amount by which toner was discharged from the toner supply container, and which can be calculated from the cumulative number of the rotations of the toner supply roller, it is impossible for the apparatus to accurately calculate the amount of the toner remaining in the toner supply container.

It is reasonable to think that the above described problems can be solved by designing a toner supplying apparatus so that the "estimated amount" equals the "actual amount". In reality, however, the cumulative effects of the component tolerance, environment in which an image forming apparatus is used, difference in properties among the toners used by an image forming apparatus, and the like factors, make it extremely difficult to manufacture a toner supplying apparatus so that the "estimated amount" by which toner is supplied to the developer container by the toner supplying apparatus equals the "actual amount" by which toner is supplied by the toner supplying apparatus.

Regarding the above described problems, U.S. Pat. No. 6,892,037 discloses a toner supplying method which adjusts the estimated amount by which toner is to be discharged, based on the number of times the toner supply screw is rotated per toner supplying operation. Further, U.S. Pat. No. 7,003,233 discloses a toner supplying method which adjusts the estimate amount by which toner will be discharged, based on the amount of the toner remaining in the toner supply cartridge and/or the condition of the environment in which the image forming apparatus is being used.

However, the methods disclosed in the abovementioned U.S. Pat. Nos. 6,892,037 and 7,003,233 are such methods that adjust the "estimated amount" based on the adjustment (correction) table, or the like, created based on the past data. They do not guarantee that the "estimated amount" is adjusted in a manner to accurately reflect the abovementioned factors.

SUMMARY OF THE INVENTION

Thus, one of the objects of the present invention is to provide an image forming apparatus which is capable of adjusting the amount by which toner is supplied to its developing apparatus(es), in response to the actual condition under which it is operated, and therefore, is capable to supplying the developing apparatus with toner by an amount significantly more accurate than the amount by which an image forming apparatus in accordance with the prior art can.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in more detail with reference to the appended drawings. Incidentally, the measurements, materials, and shapes of the structural components of the image forming apparatus, and their relative position, in each of the following embodiments of the present invention which will be described next, are not intended to limit the present invention in scope, unless specifically noted.

Embodiment 1

General Structure and Operation of Image Forming Apparatus

Figure 1:
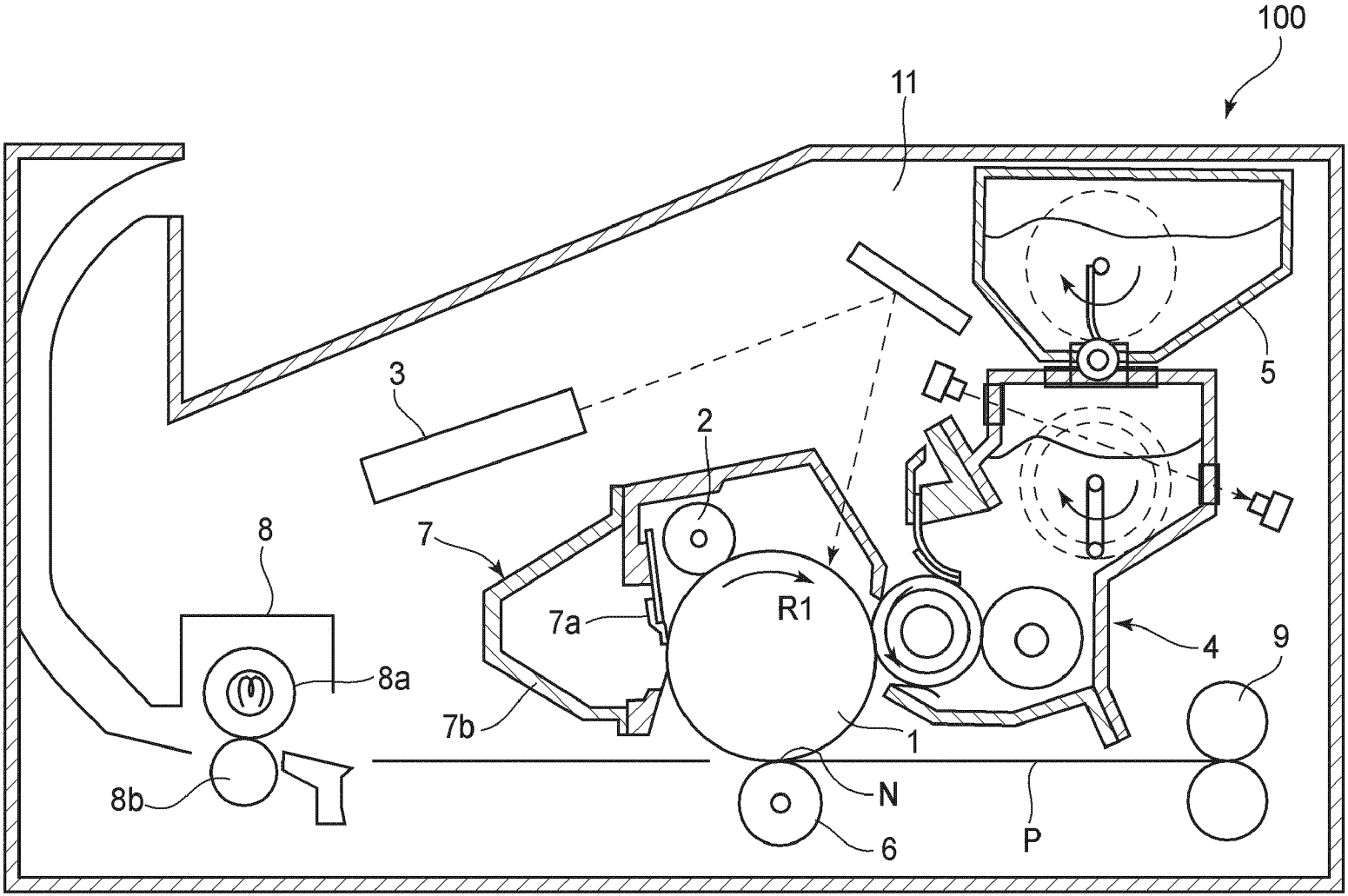
FIG. 1 is a schematic sectional view of the image forming apparatus in the first embodiment of the present invention.

First, referring to FIG. 1, an example of the structure and operation of an image forming apparatus in accordance with the present invention will be described. FIG. 1 is a schematic sectional view of the image forming apparatus 100, that is, an example of an image forming apparatus in accordance with the present invention. FIG. 1 shows the general structure of the apparatus. The image forming apparatus 100 is an electrophotographic laser beam printer.

The image forming apparatus 100 has a photosensitive drum 1, which is an electrophotographic image bearing member, which is in the form of a drum. The image forming apparatus 100 has also: a charging roller 2, which is a charging means; an exposing apparatus 3, which is an exposing means; a developing apparatus 4, which is a developing means; a transfer roller 6, which is a transferring means; and a cleaning apparatus 7, which is a cleaning means. These photosensitive drum processing means are disposed in the adjacencies of the peripheral surface of the photosensitive drum 1 in a manner to surround the peripheral surface.

The photosensitive drum 1 is located roughly in the center portion of the main assembly 11 (apparatus main assembly) of the image forming apparatus. It is rotatably supported so that it can be rotated in the direction (clockwise direction) indicated by an arrow mark R1 in the drawing. As an image forming operation is started, the peripheral surface of the photosensitive drum 1 is uniformly charged to preset polarity and potential level by the charge roller 2. Then, the uniformed charged portion of the peripheral surface of the photosensitive drum 1 is exposed by the exposing apparatus 3. More specifically, the uniformly charged portion of the peripheral surface of the photosensitive drum 1 is scanned by the beam of laser light projected by the exposing apparatus 3 while being modulated in accordance with the image formation data. As a result, an electrostatic image (latent image) is formed on the photosensitive drum 1. In this embodiment, the normal polarity to which the photosensitive drum 1 is chargeable is negative. Further, the exposing apparatus 3 in this embodiment is a scanning apparatus which employs a means for projecting a beam of laser light.

After the electrostatic image is formed on the photosensitive drum 1, it is developed into a visible image. That is, as the photosensitive drum 1 is rotated, toner is supplied to the electrostatic image on the peripheral surface of the photosensitive drum 1 by the developing apparatus 4, forming an image of toner, on the photosensitive drum 1.

Incidentally, the developing method employed in this embodiment is one of the so-called reversal developing methods. That is, among the numerous points of the electrostatic image formed on the photosensitive drum 1, the toner, which has been charged to the negative polarity, that is, the same polarity as the polarity to which photosensitive drum 1 was charged, adheres to the negative charged points (exposed points), which were reduced in electric charge by being exposed by the beam of laser light projected by the exposing apparatus 3. Although it will be described later in more detail, the developing apparatus 4 in this embodiment uses a magnetic single-component developer (toner). The replenishment toner is supplied to the developing apparatus 4 from a toner supplying apparatus 5 (which hereafter may be referred to as toner hopper), which is a developer (toner) supplying apparatus.

After being formed on the photosensitive drum 1, the toner image is transferred onto a transfer medium P by the function of a transfer roller 6, in a transfer area N, which is the area of contact between the photosensitive drum 1 and transfer roller 6. During this operation, a transfer bias, which is opposite in polarity from the normal polarity (which is negative in this embodiment) to which toner is chargeable, is applied to the transfer roller 6, generating a transfer electric field in the transfer area N. Incidentally, the transfer medium P is conveyed from a cassette (unshown), which is a transfer medium storage portion, to the transfer area N by a transfer medium conveyance roller 9 or the like, in synchronism with the timing with which the toner image on the photosensitive drum 1 arrives at the transfer area N.

After the toner image on the photosensitive drum 1 is transferred onto the transfer medium P, the transfer medium P is conveyed to a fixing apparatus 8 as a fixing means. In the fixing apparatus 8, the unfixed toner image on the transfer medium P is subjected to the heat from a heat roller 8*a* as a heating means, and the pressure from a pressure roller 8*b* as a pressure applying means, being thereby fixed to the surface of the transfer medium P. After the fixation of the toner image, the transfer medium P is discharged, as a print (copy) of the intended image, out of the apparatus main assembly 11.

The transfer residual toner, that is, the toner remaining on the peripheral surface of the photosensitive drum 1 after the completion of the transfer process, is removed and recovered by the cleaning apparatus 7, whereby the photosensitive drum 1 is prepared for the continuation of the current image forming operation or the following image forming operation. The cleaning apparatus 7 has an elastic cleaning blade 7*a* and a toner container 7*b*. The elastic blade 7*a*, which is a cleaning member, is placed in contact with the photosensitive drum 1. The toner container 7*b* stores the transfer residual toner removed from the photosensitive drum 1 by the elastic blade 7*a* (cleaning blade).

[Developing Apparatus]

Figure 2:
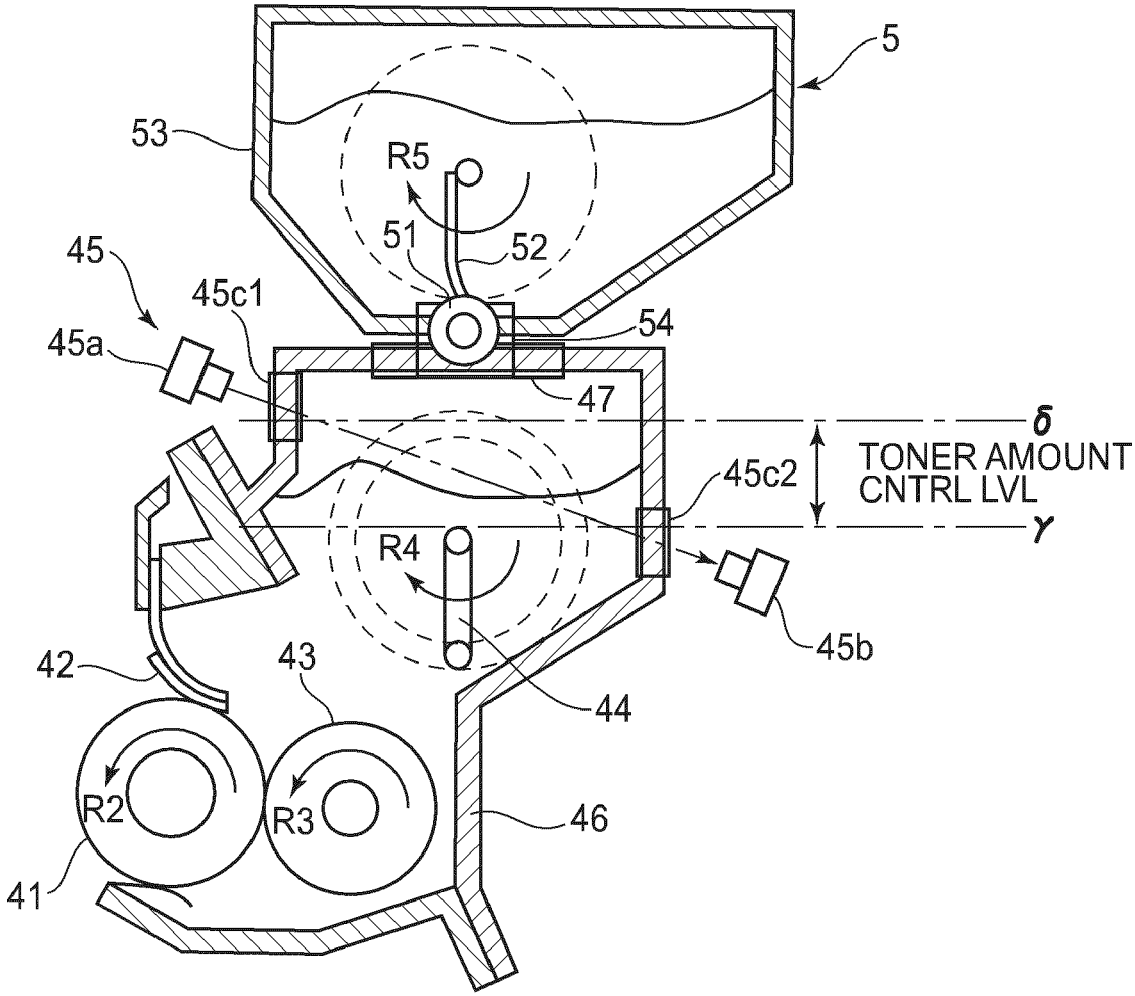
FIG. 2 is a schematic sectional view of the combination of the developing apparatus and toner hopper, with which the image forming apparatus in the first embodiment is provided.

Next, referring to FIG. 2, the developing apparatus 4 will be further described.

The developing apparatus 4 has a developer container 46 (developing apparatus frame (housing)) which stores toner as developer. The developer container 46 is provided with a development roller 41 as a developer bearing member. The development roller 41 bears toner and conveys the toner to supply the toner to the electrostatic image on the photosensitive drum 1. The developing apparatus 4 is also provided with a supply roller 43, which functions not only as the means for supplying the development roller 41 with toner, but also, as the means for recovering the toner from the development roller 41. Further, the developing apparatus 4 is provided with a development blade 42, which is a developer layer thickness regulating member, and functions as the developer regulating means for forming a uniform layer of toner on the peripheral surface of development roller 41 by regulating the body of toner supplied to the peripheral surface of the development roller 41 by the supply roller 43. Further, the developing apparatus 4 is provided with a stirring paddle 44 and a developer amount detecting apparatus 45. The stirring paddle 44 is a developer stirring means for mixing the toner in the developer container 46 with the replenishment toner (replenishment developer) delivered from the toner hopper 5. The developer amount detecting apparatus 45 is a toner amount detecting means for detecting the amount of the toner in the developer container 46.

The toner used as developer in this embodiment is a non-magnetic single-component toner, which normally is chargeable to the negative polarity.

The developer container 46 is provided with an opening, which faces the photosensitive drum 1. The development roller 41 is rotatably supported by the developer container 46 (developing means housing) in such a manner that it is partially exposed through this opening of the developer container 46. The development roller 41 is made up of a metallic core and an elastic layer (elastic portion). The elastic layer is formed of an elastic substance, such as silicone rubber, urethane, foamed version thereof, and combinations thereof, which are relatively low in hardness. The material for the elastic layer contains electrically conductive substance, such as carbon, which is dispersed in the material. The volume resistivity of the elastic layer is in a range of 1 Ωm ($10^2$ Ωcm)-$10^8$ Ωm ($10^{10}$ Ωcm). That is, the development roller 41 is a semiconductive elastic roller which is 20 mm in diameter. The development roller 41 is kept pressed toward the photosensitive drum 1 by a pressure applying means, being thereby kept in contact with the photosensitive drum 1 with the presence of a preset amount of contact pressure between the development roller 41 and photosensitive drum 1. The development roller 41 is rotationally driven in the direction (counterclockwise) indicated by an arrow mark R2 in the drawing. The photosensitive drum 1 and development roller 41 are rotationally driven so that the peripheral surface of the photosensitive drum 1 and the peripheral surface of the development roller 41 move in the same direction in the area of contact (development area) between the photosensitive drum 1 and development roller 41.

The supply roller 43 in this embodiment is also an elastic roller, which is made up of a metallic core, and an elastic layer formed in a manner to virtually entirely wrap the peripheral surface of the metallic core. More specifically, the elastic layer of the supply roller 43 is formed of dielectric sponge. The supply roller 43 is 16 mm in diameter. The supply roller 43 is kept pressed toward the development roller 41 by a pressure applying means, being thereby kept in contact with the development roller 41 with the presence of a preset amount of contact pressure between the supply roller 43 and development roller 41. The supply roller 43 is rotationally driven in the direction (counterclockwise) indicated by an arrow mark R3 in the drawing. That is, the supply roller 43 and development roller 41 are rotationally driven so that the peripheral surface of the supply roller 43 and the peripheral surface of the development roller 41 move in the opposite directions in the area of contact (development area) between the supply roller 43 and development roller 41.

In this embodiment, the process speed, which is equal to the peripheral velocity of the photosensitive drum 1, is 150 mm/sec, and the peripheral velocity of the development roller 41 is 225 m/sec.

The stirring paddle 44, which is a means for conveying the developer while stirring it, is in the rear portion of the developer container 46, that is, the portion opposite from the abovementioned opening of the developer container 46. The stirring paddle 44 is rotationally driven in the direction (clockwise direction) indicated by an arrow mark R4 in the drawing. The stirring paddle 44 conveys the toner in the developer container 46 to the adjacencies of the area of contact between the development roller 41 and supply roller 43 while stirring the toner.

After being conveyed to the adjacencies of the area of contact between the development roller 41 and supply roller 43, the toner is rubbed by the supply roller 43 and development roller 41, becoming electrically charged; it is given triboelectric charge by the supply roller 43 and development roller 41. As the toner is given the triboelectric charge, it is affected by the development roller 41 because of the electric charge it received, being thereby borne on the peripheral surface of the development roller 41.

The development blade 42 is a blade formed of an elastic substance, and is attached to the developer container 46 so that the portion of the development blade 42, which is next to its free edge, is kept pressed upon the peripheral surface of the development roller 41. The development blade 42 is formed of stainless steel or the like substance. In a case where the development blade 42 is formed of stainless steel or the like, it is to be L-shaped in cross-section so that the portion of the development blade 42, which is next to its free edge, is kept pressed upon the peripheral surface of the development roller 41.

After being borne on the peripheral surface of the development roller 41, the toner is formed into a uniform layer by the development blade 42 while being regulated in thickness and being further charged. As a result, a thin layer of toner is formed on the peripheral surface of the development roller 41. Then, this thin layer of toner is conveyed further by the rotation of the development roller 41 to the development area, in which the toner particles in the toner layer on the development roller 41 transfer onto the peripheral surface of the photosensitive drum 1 in a pattern which reflects the electrostatic image on the peripheral surface of the photosensitive drum 1, developing thereby the electrostatic image into an image formed of toner (which hereafter will be referred to as toner image).

The toner remaining on the development roller 41 even after it was moved through the development area, that is, the toner on the development roller 41, which did not transfer onto the peripheral surface of the photosensitive drum 1, is scraped away from the development roller 41 by the supply roller 43 as it is rubbed by the supply roller 43. A part of the toner scrapped away from the development roller 41 by the supply roller 43 is borne back onto the development roller 41 along with the body of toner freshly supplied to the development roller 41, whereas the rest is returned to the developer container 46.

In this embodiment, the supply roller 43 plays two roles. That is, not only does it functions as the means for supplying the development roller 41 with toner, but also, as the means for recovering the toner from the development roller 41. However, the developer supplying means and developer recovering means may be independent from each other. Further, the developing method does not need to be limited to the contact developing method, which places the developer bearing member in contact with the photosensitive drum 1. For example, a jumping developing method may be used, which keeps a photosensitive drum separated from a developer bearing member so that the toner transfers onto the photosensitive drum by jumping from the developer bearing member onto the photosensitive drum.

Also in this embodiment, the developing apparatus 4 is structured so that it is removably mountable in the apparatus main assembly 11. Thus, as the cumulative length of the usage of the essential components (development roller, development blade, etc.) of the developing apparatus 4 exceeds a preset value (which is equivalent to 30,000 copies of A4 size), the developing apparatus 4 can be removed from the apparatus main assembly 11 to be replaced.

[Toner Supplying Apparatus]

The image forming apparatus 100 in this embodiment is provided with a toner hopper 5, which functions as a toner supplying apparatus (mechanism), as a developer supplying apparatus for supplying (replenishing) the developing apparatus 4 with developer.

The toner hopper 5 has a replenishment toner container 53 (main assembly of toner hopper), that is, a replenishment developer container (replenishment developer storage portion). In this embodiment, the replenishment toner container 53 stores replenishment toner as replenishment developer. The toner hopper 5 has a toner supply roller 51, which is a developer supplying member for supplying the developer container 46 with the toner from the replenishment toner container 53. The toner hopper 5 also has a stirring member 52, which is placed in the replenishment toner container 53 to loosening the toner in the replenishment toner container 53. The stirring member 52 is rotationally driven in the direction (clockwise direction) indicated by an arrow mark R5 in the drawing.

As the toner supply roller 51 of the toner hopper 5 is rotated by a toner replenishment command from a controlling apparatus (which will be described later), the toner in the replenishment toner container 53 is supplied to the developer container 46 through the openings 54 and 47, with which the replenishment toner container 53 and developer container 46 are provided, respectively. The toner hopper 5 in this embodiment is structured so that a preset amount of toner is supplied to the developer container 46 from the replenishment toner container 53 per unit quantity by which the toner hopper 5 is driven, that is, per unit length of time the toner supply roller 51 is driven.

The image forming apparatus 100 is provided with a controlling apparatus which controls the operational sequence for replenishing the developing apparatus 4 with the developer from the toner hopper 5, by an amount proportional to the amount by which the developer was consumed through the development process. As the controlling apparatus which controls the above described sequence, the CPU, with which the control portion which controls the overall operation of the image forming apparatus 100, or an electric circuit dedicated to the controlling the above described operational sequence, may be employed. In this embodiment, the image forming apparatus 100 is structured so that the CPU 35 (FIG. 5) of the control portion of the apparatus main assembly 11, which is for controlling the overall operation of the image forming apparatus 100, controls the toner replenishment operation carried out by the toner hopper 5.

Figure 3:
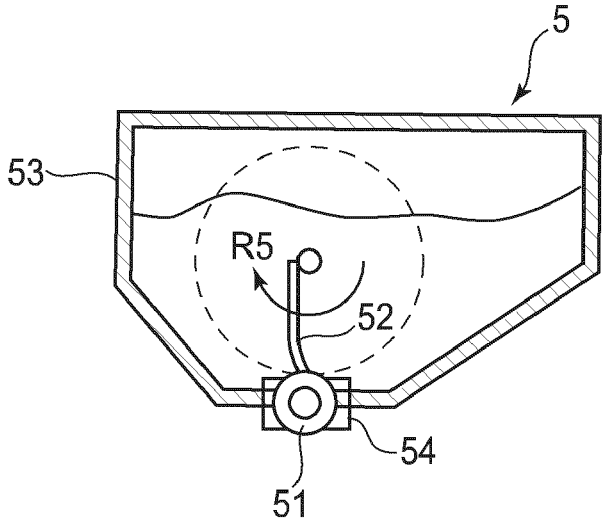
FIG. 3 is a schematic sectional view of the toner hopper with which the image forming apparatus in the first embodiment of the present invention is provided.

Referring to FIG. 3, in this embodiment, the toner hopper 5 and apparatus main assembly 11 are structured so that the toner hopper 5 is removably mountable in the apparatus main assembly 11. That is, the toner hopper 5 is structured as a replenishment toner cartridge (toner bottle) which is removably mountable in the apparatus main assembly 11. Thus, as the toner hopper 5 is depleted of the replenishment toner therein, the toner hopper 5 is removed from the apparatus main assembly 11 to be replaced with another toner hopper (5), making it possible for the developing apparatus 4 to be continuously supplied with a necessary amount of toner. Not only does this structural setup make it possible to replace in entirety the toner hopper 5 in the apparatus main assembly 11, making it easier to replenish the developing apparatus 4 with toner, but also, to prevent the contamination attributable to the scattering of toner.

[Toner Amount Detecting Means and Video Counting Apparatus]

In this embodiment, a toner amount detecting apparatus and a video counting apparatus are used to control the toner replenishment operation. The toner amount detecting apparatus is the means for detecting the amount of the toner in the developer container. The video counting apparatus is the means for calculating the amount by which developer is theoretically consumed through the development process.

The image forming apparatus 100 in this embodiment has: the developing apparatus which develops an electrostatic image with the use of developer; a toner amount detecting means; and a video counting apparatus. The image forming apparatus 100 also has a cumulative developer consumption amount calculating apparatus, and the toner hopper 5. The cumulative developer consumption amount calculating apparatus calculates the cumulative amount of developer consumption by accumulating the amount by which the developer is consumed each time an electrostatic image is developed. The toner hopper 5 is an apparatus which replenishes the developing apparatus with developer. Further, the image forming apparatus 100 has the CPU (Figure), which functions as a controlling apparatus for controlling the operation for replenishing the developing apparatus with the developer from the developer supplying apparatus. Each time the cumulative amount of developer consumption exceeds the threshold value, the controlling apparatus causes the developer supplying apparatus to deliver a preset amount of toner to the developing apparatus, and also, adjusts the abovementioned threshold value according to the amount of the developer in the developing apparatus, which was detected by the developer amount detecting apparatus. Hereafter, the operation for replenishing the developing apparatus with developer, and the components, portions, etc., which are involved in the operation will be described in more detail.

(Toner Amount Detecting Means)

First, a toner amount detecting apparatus, which is used as a developer amount detecting means 45 in this embodiment will be described.

The CPU 35 (FIG. 4) with which the apparatus main assembly 11 is provided obtains the information regarding the position of the top surface (which hereafter will be referred to as "toner surface") of the body of toner in the developer container 46, from the toner amount detecting means 45. From this information, the CPU 35 determines the amount of the toner in the developer container 46, and controls the operation for delivering the toner in the toner hopper 5 to the developer container 46, following the control sequence, which will be described later. More specifically, the CPU 35 controls the toner supplying operation, based on the information regarding the toner surface position, which was obtained from the toner amount detecting means 45, so that the toner surface remains in the preset range, that is, between a level γ and a level δ, which fall in the sweeping range of the stirring paddle 44.

To describe in more detail, the stirring paddle 44 is attached to the developer container 46 (developing apparatus frame) so that it is rotatable in the direction indicated by an arrow mark R4. In practical terms, the toner stirring area, that is, the area in which the toner in the developer container 46 is mixed with the toner supplied from the toner hopper 5, coincides with the abovementioned sweeping range of the stirring paddle 44.

The toner amount detecting means 45 is an optical means (toner surface detecting means) for optically detecting the position of the toner surface, which is in the sweeping range of the stirring paddle 44. The toner amount detecting means 45 has a light emitting portion 45*a* and a light receiving portion 45*b*, which have a light emitting element and a light receiving element, respectively. The light emitting portion 45*a* and light receiving portion 45*b* are positioned outside the developer container 46 in a manner to sandwich the stirring range of the stirring paddle 44. Further, the toner amount detecting means 45 has a transparent window 45*c*1 and a transparent window 45*c*2, which are fitted in the opposing two walls of the developer container 46, one for one.

The information regarding the position of the toner surface in the abovementioned stirring range, that is, the information regarding the amount of the toner in the developer container 46, is obtained by measuring the ratio of the length of time the beam of light from the light emitting portion 45*a* is allowed to transmit through the developer container 46, to the length of time the beam of light is not allowed to transmit through the developer container 46, while the toner surface is changed in position by the rotation of the stirring paddle 44. This toner amount information can be used as it is. In this embodiment, however, in order to minimize the effects of measurement error, the toner amount information is averaged for every five image outputs to obtain an average amount AVG of the toner in the developer container 46. That is, in this embodiment, the average amount AVG is used to determine the amount of the toner in the developer container 46. The average amount AVG is calculated by the CPU 35. Further, the CPU 35 makes the nonvolatile memory 36 (FIG. 4), which is a storage apparatus connected to the CPU 35, to store in succession the calculated average amount AVG of the toner in the developer container 46. The nonvolatile memory 36 in this embodiment is a part of the apparatus main assembly 11.

In this embodiment, the toner amount detecting means 45 is capable of detecting the amount of the toner in the developer container 46, when the toner surface is at the "low toner level Low" and "high toner level Hi", which corresponds to the first toner amount control level γ, and the second toner amount control level δ, respectively.

(Video Counting Apparatus)

Next, the video counting apparatus, which is used as the developer consumption amount calculating apparatus in this embodiment, will be described. The video counting apparatus calculates the video count based on the image formation data for forming an electrostatic image on the photosensitive drum 1. There is a correlation between the video count and the amount by which toner will be consumed when the electrostatic latent image is developed. Thus, the amount by which toner will be consumed can be estimated from the video count.

Figure 4:
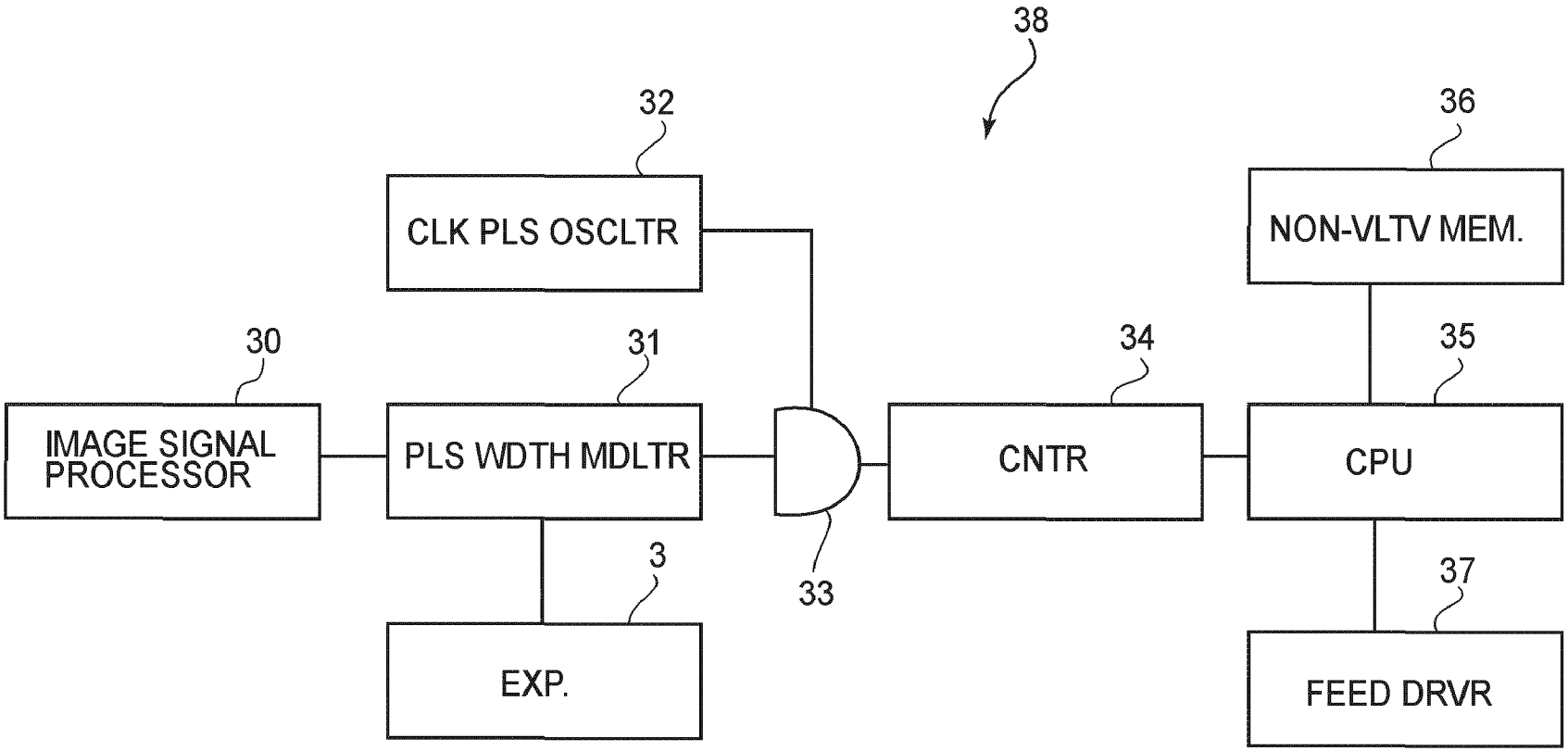
FIG. 4 is a block diagram of an example of a video counting apparatus usable for toner supply control.
Figure 5:
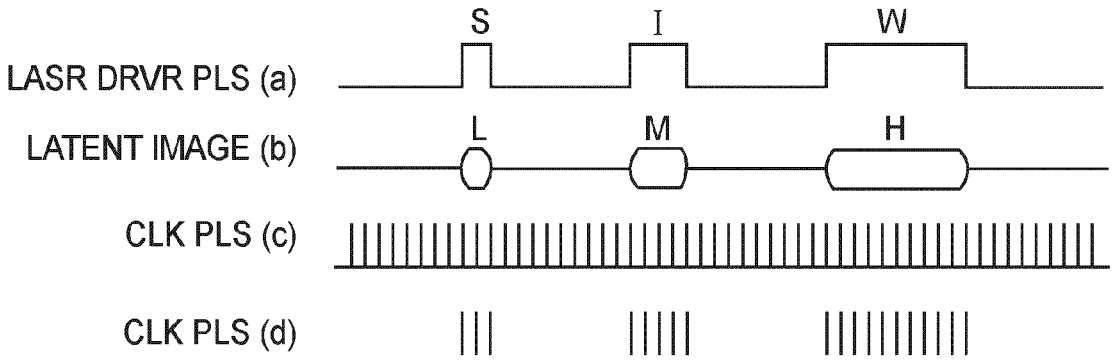
FIG. 5 illustrates the principle based on which video signals are counted.

FIG. 4 is a block diagram for describing the video counting apparatus 38 in this embodiment. FIG. 5 is a schematic drawing for describing the principle of video counting (pixel counting).

In this embodiment, in order to successively supply toner to the developer container 46 by the amount equal to the amount by which toner was consumed for developing an electrostatic image, the output signals of the exposing apparatus 3 are counted in signal level per pixel. The method used to count the output signals is as follow:

The exposing apparatus 3 in this embodiment is a laser scanner, which has a semiconductor laser, a rotational polygon mirror, lenses, etc. The beam of laser light projected from the semiconductor laser is reflected by the rotational polygon mirror, being thereby moved in a scanning manner, and is focused as a moving spot of light on the peripheral surface of the photosensitive drum 1 by lenses, such as an f-θ lens, etc., and a stationary mirror which directs the laser beam toward the photosensitive drum 1. The moving spot of light, that is, the beam of laser light focused on the peripheral surface of the photosensitive drum 1 scans the peripheral surface of the photosensitive drum 1 in the direction (primary scan direction), which is roughly parallel to the axial line of the photosensitive drum 1. As a result, an electrostatic image is effected on the peripheral surface of the photosensitive drum 1.

The information regarding an electrostatic image to be formed is inputted into a pulse width modulation circuit 31 from a personal computer, an image inputting scanner, or the like, through an image processing circuit 30. For every picture element signal inputted, a laser driving pulse, the duration of which corresponds to the level of the picture element signal, is sent from the pulse width modulation circuit 31 to the exposing apparatus 3. Thus, the exposing apparatus 3 causes its semiconductor laser to emit a beam of laser light for a length of time proportional to the pulse width. Therefore, the higher a pixel in density, the longer the semiconductor laser is driven; that is, the lower a pixel in density, the shorter the semiconductor laser is driven.

More concretely, the laser pulses are formed as shown in FIG. 5(*a*). That is, for an image signal corresponding to a high density pixel, a laser driver pulse W, which is wide, is created, whereas for an image signal corresponding to a low density pixel, a laser driver pulse S, which is relatively narrow, is created. Further, for an image signal corresponding to a medium density pixel, a laser driver pulse I, the width of which is between the width of the pulse W and the width of the pulse S.

Thus, as an image signal corresponding to a high density pixel is inputted, the photosensitive drum 1 is exposed longer in terms of the primary scan direction than the length of time the photosensitive drum 1 is exposed as an image signal corresponding to a low density pixel is inputted, a shown in FIG. 5(*b*). That is, the dot size which corresponds to each pixel of an electrostatic image corresponds to the density of the pixel. Therefore, the amount of toner consumption per high density pixel is greater than that per low density pixel. Incidentally, the shapes of low (L), medium (M), and high (H) density pixels, one for one, which are shown in FIG. 5(*b*) are arbitrary, simply showing their relative sizes.

In addition to the above described process, the output signal from the pulse width modulation circuit 31 is supplied to one of the inputs of an AND gate 33. To the other input of the AND gate 33, a clock pulse (pulse shown in FIG. 5(*c*)) is supplied from a clock pulse generating device 32. Thus, the number of the clock pulses which are outputted each time an image signal is inputted is proportional to the density of the corresponding pixel, as shown in FIG. 5(*d*). These clock pulse counts are added up per image by the counter 34. Thus, the final video count, which corresponds to the overall print ratio of the electrostatic image to be formed, is obtained by accumulating all the video counts which correspond to all the pixels, one for one, of an image to be formed.

In this embodiment, the video counting apparatus 38 is made up of the abovementioned clock pulse generating device, AND gate 33, and also, a counter 34.

[Toner Supply Control]

Next, the toner supply control in this embodiment will be described.

The video count obtained by the exposing apparatus 3 as described above, is roughly proportional to the amount by which toner will be consumed by the developing apparatus 4 to develop an electrostatic image on the photosensitive drum 1 into a visible image. In this embodiment, therefore, this video count is supplied to the CPU 35. The CPU 35 calculates the "amount by which toner will be consumed per print" by the developing apparatus 4, based on this video count. The "amount by which toner will be consumed per print" corresponds to the "amount of toner to be supplied per print". That is, the CPU 35 calculates the amount t1 by which the developer container 46 is to be, supplied, per image output, with developer.

In this embodiment, the amount t1 by which toner is to be supplied is not directly related to the amount by which toner is supplied per toner supplying operation. That is, the CPU 35 accumulates the amount t1 by which toner is to be supplied each time an image is outputted. That is, the CPU 35 obtains the cumulative amount t2 by which toner is to be supplied per preset number of prints made, by adding up all the amounts t1 by which toner is to be supplied as each time a preset number of prints are outputted. Then, the CPU 35 makes the nonvolatile memory 36, which is a data storage apparatus connected to the CPU 35, store in succession the cumulative amounts t2 by which toner is to be supplied. This cumulative amount t2 (total amount) is the amount by which toner is to be supplied to the developing apparatus 4 per toner supply operation. That is, in this embodiment, the CPU 35 also functions as a cumulative developer consumption amount calculating apparatus.

Also in this embodiment, the amount by which toner is supplied to the developer container 46 from the replenishment toner container 53 per toner supply operation is preset as threshold toner supply amount t3. The threshold toner supply amount t3 is stored in advance in the nonvolatile memory 36, which is the data storage apparatus connected to the CPU 35.

Further, as the cumulative amount t2 by which toner is to be supplied exceeds the threshold toner supply amount t3, the CPU 35 activates once a toner supplying apparatus driving apparatus 37 (FIG. 4), which is a part of the toner hopper 5 and rotationally drives the toner supply roller 51. The number of times the toner supply roller 51 is rotated each time the toner supplying apparatus driving apparatus 37 is activated remains practically constant.

Next, the CPU 35 subtracts the threshold toner supply amount t3 from the cumulative amount t2 by which toner is to be supplied. To the remainder of the subtraction, the value of the amount t1 by which toner is to be supplied is added, each time the amount t1 is calculated for subsequent image formation.

More concretely, in this embodiment, the toner hopper 5 is designed so that each time the toner hopper 5 is activated, the toner supply roller 51 is rotated two full turns. That is, the length of time the toner hopper 5 is operated per toner supply request is not varied. That is, one of the essential characteristic features of the toner hopper 5 in this embodiment is that its operation is fixed. As is evident from above, in this embodiment, the quantity by which the toner supply roller 51 is to be rotated per toner hopper operation is fixed to a specific value, in particular, an integer (two in this embodiment). Therefore, the toner supplying apparatus in this embodiment is more reliable than a toner supplying apparatus which is variable in the quantity by which toner supply roller 51 is rotated per toner supply operation, in terms of the effect that the amount by which toner is supplied to the developer container converges to a preset value.

Figure 6:
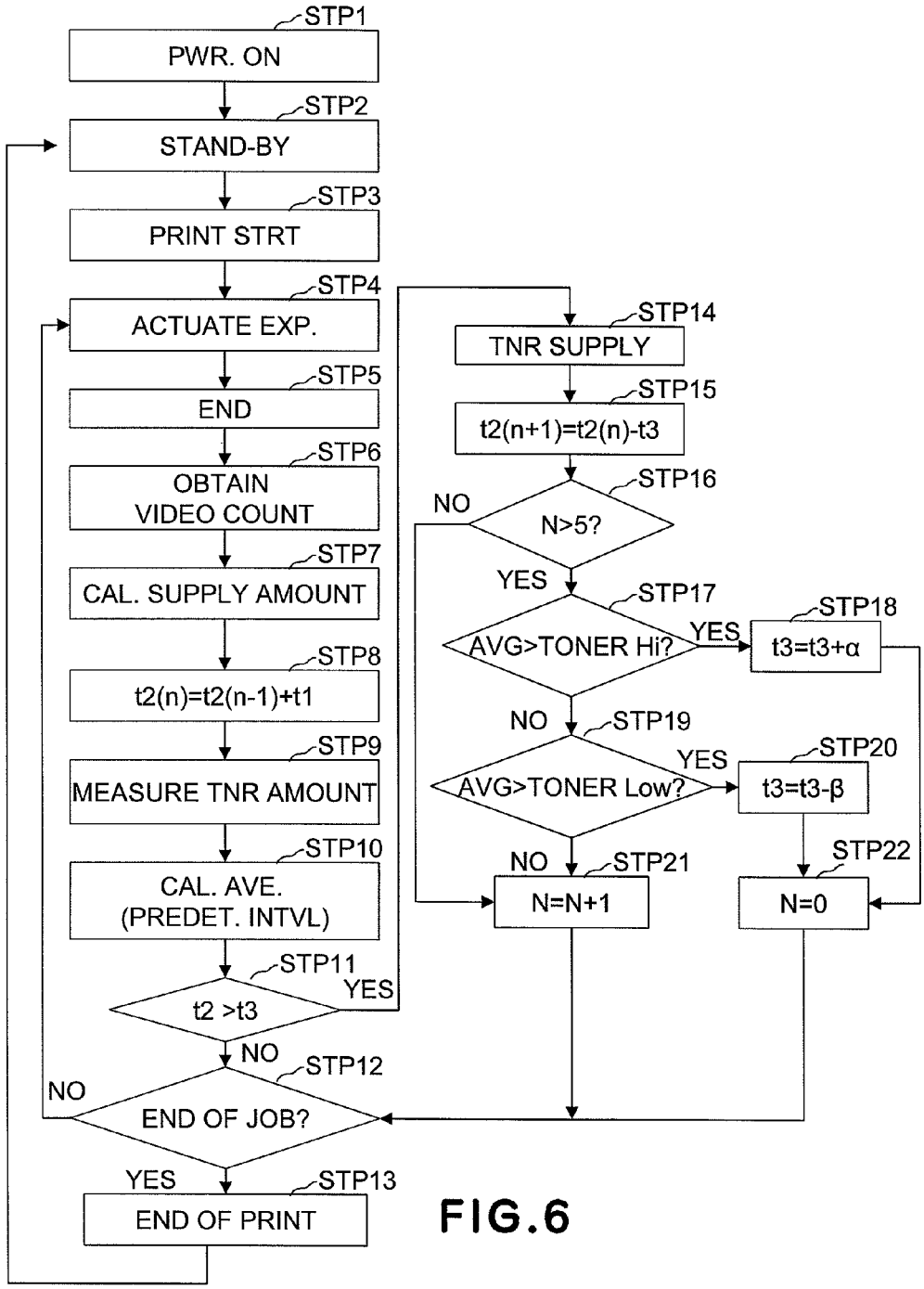
FIG. 6 is a flowchart of an example of a toner supply control sequence.

Next, referring to FIG. 6, which is a flowchart, the toner supplying operation in this embodiment will be described.

After the power source of the image forming apparatus 100 is turned on (Step 1), a preset startup operation is carried out. After the completion of the startup operation, the image forming apparatus 100 remains on standby (Step 2). As the image forming apparatus 100 receives a print start signal while being on standby, it starts a printing operation, sequentially activating the photosensitive drum 1, charge roller 2, developing apparatus 4, etc. (Step 3). Just about when the various portions of the image forming apparatus 100 become ready for image formation, the image forming apparatus 100 begins to activate the exposing apparatus 3 to form an electrostatic image, and also, to acquire the video count data (Step 4). As soon as the formation of the electrostatic image is completed, the image forming apparatus 100 stops the exposing apparatus 3, and also, stop adding up the video count, obtaining the cumulative video count (Steps 5 and 6).

The CPU 35 calculates the amount by which toner is to have been consumed by the developing apparatus 4 per print, that is, the amount t1, by which toner is to be supplied per print, based on the obtained cumulative video count (Step 7). Then, the CPU 35 accumulates the amounts t1 by which toner is to be supplied to the developer container 46 per preset number of prints, to obtain the cumulative amount t2 by which toner is to be supplied to the developing apparatus 46 per preset number of prints. Then, the CPU 35 makes the nonvolatile memory 36 to store in succession the cumulative amount t2 by which the toner is to be supplied (Step 8).

Next, the CPU 35 acquires the information regarding the amount of toner in the developer container 46 by the toner amount detecting means 45 (Step 9). Then, it calculates the average amount AVG (average toner amount) per preset number of image output (prints), and makes the nonvolatile memory 36 to store the value of the average amount AVG (Step 10). In this embodiment, the CPU 35 renews the value of the average amount AVG in the nonvolatile memory 36 every five images (prints) outputted.

Next, the CPU 35 compares the cumulative amount t2 by which toner is to be supplied, with the threshold toner supply amount t3 (Step 11). If the CPU 35 determines that the cumulative amount t2 is equal to, or smaller than, the threshold toner supply amount t3, it does not require the toner hopper 5 to deliver toner to the developer container 46. Also in this case, it determines whether or not the job has been completed (Step 12). On the other hand, if the CPU 35 determines that the cumulative amount t2 is greater than the threshold toner supply amount t3, it makes the toner hopper 5 to carry out the toner supplying operation once (Step 14). Thereafter, the CPU 35 subtracts the threshold toner supply amount t3 from the cumulative amount t2 (Step 15).

Next, the CPU 35 determines whether or not the number N of times the toner supplying operation was carried out without carrying out the operation for adjusting the threshold toner supply amount t3 exceeded five times (preset number Nt) (Step 16). The operation for adjusting the threshold toner supply amount t3 will be described later. If the CPU 35 determines that the value of the number N is greater than 5, it compares the average amount AVG of toner, with the threshold toner supply amount t3 (Steps 17 and 19). In this embodiment, two threshold amounts t3 are provided, that is, a "low threshold amount" which corresponds to the first toner amount control level $\gamma$, and a "high threshold value" which corresponds to the second toner amount control level $\delta$. The values of these levels are stored in advance in the nonvolatile memory 36 which is the data storage apparatus connected to the CPU 35. Incidentally, in this embodiment, the average amount AVG of toner is the amount of toner used per electrostatic image (print) during the preset length of time immediately before a toner supplying operation is carried out. However, this practice is not intended to limit the present invention in scope. That is, the average amount AVG of the toner in the developer container 46 may be the average amount of the toner used for developing an electrostatic images (outputting a print), by the preset number of image forming operations carried out immediately before and after the toner supplying operation. All that is necessary is to find out the average amount of toner, which was (is) immediately before, after, or in-between when the toner is supplied from the toner hopper 5.

That is, first, the CPU 35 compares the average amount AVG of the toner with the high threshold value Hi (Step 17). If the CPU 35 determines that the "average toner amount" AVG is greater than the high threshold value Hi, the CPU 35 adjusts the threshold toner supply amount t3; it increases the threshold toner supply amount t3 by a preset amount $\alpha$ (Step 18). On the other hand, if it determines that the average amount AVG of the toner is equal to, or smaller than the high threshold value Li, it compares the average amount AVG for the toner with the low threshold value Low (Step 19). If it determines that the average amount AVG is smaller than the low threshold value Low, it adjusts the threshold toner supply amount t3; it reduces the threshold toner supply amount t3 by a preset amount β (Step 20).

If the CPU 35 determines in Step 16 that the value of number N is equal to, or smaller than five, and also, determines in Steps 17 and 19 that the average amount AVG of toner is equal to, or greater than the low threshold value Low, and also, is equal to, or smaller than the high threshold value Hi, the CPU 35 adds one to the value of the toner supplying operation count N (Step 21). On the other hand, if the CPU 35 adjusts the threshold toner supply amount t3 in Steps 18 or 20, it resets the toner supplying operation count N to zero (Step 22). In this embodiment, the number N of times the toner supplying operation is carried out and the threshold number Nt (which is five in this embodiment) for the interval in terms of toner supplying operation count is stored in the nonvolatile memory 36 which is the data storage apparatus connected to the CPU 35.

Next, the CPU 35 determines whether or not the job (image formation sequence to be carried out to make a single or multiple prints) in response to an image formation start command has been completed (Step 12). If it determines that the job has not been completed, and therefore, the printing operation has to be continued, it causes the image forming apparatus 100 to go back to the exposing step to restart the interrupted image forming operation (Step 4), reactivating the exposing apparatus 3. On the other hand, if the CPU 35 determines that there is no image (print) left to be formed by the job, it causes the image forming apparatus 100 to sequentially stop the various processing means of the image forming apparatus 100, ending thereby the image forming operation (Step 13), and then, puts the image forming apparatus 100 on standby again (Step 2).

At this time, the toner supplying operation in this embodiment will be more concretely described. The various settings for the toner supplying operation are as follows:

A: amount of toner used to form a toner image of the highest density on the photosensitive drum 1 (=0.6 mm/cm$^2$)

S: size of transfer medium (of A4 size) (=21.0 cm×29.7 cm)

R: printing ratio calculated from the video count (=0-100%)

t1: amount by which toner is to be supplied to the developer container 46 per image output (per print) (=amount by which toner is consumed per image output (per print)

t1=A×S×R t2=cumulative amount by which toner is to be supplied to the developer container 46 t3=threshold amount by which toner is to be supplied to the developer container 46

Nt=minimum interval with which the threshold toner supply amount t3 is to be adjusted (=five toner supplying operations)

α: amount by which threshold toner supply amount t3 is to be adjusted if the amount of toner in the developer container 46 exceeds a level Hi (=10 mg)

β: amount by which threshold toner supply amount t3 is to be adjusted if the amount of toner in the developer container 46 falls below the level Lo (=10 mg).

In this embodiment, the amount t1 (which is equal to amount of toner consumption), by which toner is to be supplied to the developer container 46, is calculated from the video count obtained through the video counting apparatus. However, the method for calculating the amount t1 does not need to be limited to the one used in this embodiment. For example, the amount by which toner will be consumed may be calculated by the CPU 35 from the printing ratio of the image to be formed, by developing the information regarding the image to be formed, which is sent from a personal computer or the like. In this case, the CPU 35 functions as a printing ratio calculating apparatus and a developer consumption amount calculating apparatus.

The developer container 46 in this embodiment is designed to hold 70 g of toner. The toner amount detecting means 45 is designed so that as the amount of toner in the developer container 46 exceeds 75 g, it determines that the position of the toner surface has become higher than the level Hi, whereas as the amount of toner in the developer container 46 falls below 65 g, it determines that the position of the toner surface has fallen below the level Low. Regarding the adjustment of the threshold toner supply amount t3, as the position of the toner surface becomes higher than the level Hi, the threshold toner supply amount t3 is increased by 10 mg, whereas as the position of the toner surface becomes lower than the level Low, the threshold toner supply amount t3 is reduced by 10 mg.

The number Nt is the minimum number of intervals with which the threshold toner supply amount t3 is to be adjusted. That is, in this embodiment, the threshold toner supply amount t3 is not adjusted until the toner supplying operation is carried out by the Nt (=5) times after the last threshold toner supply amount adjustment. Thus, principally, there is a certain amount of time lag between when the toner amount detecting means 45 detects that the position of the toner surface is above or below the level Hi or Low, respectively, and when the amount of the toner in the developing apparatus 4 begins to reflect the result of the detection. This is why the number Nt of the intervals is set to prevent the problem that the threshold toner supply amount t3, that is, the amount by which toner is supplied per toner hopper operation, is too frequently adjusted. That is, the image forming apparatus 100 in this embodiment is designed so that unless the toner supplying operation is carried out a preset number of times, the controlling apparatus does not adjust the threshold toner supply amount t3. If the number Nt of the intervals is excessively small, the threshold toner supply amount t3 is adjusted too frequently. In other words, if the number Nt of the intervals is set to an excessively small value, the image forming apparatus 100 is liable to become excessively sensitive to the output of the toner amount detecting means 45. On the other hand, the value of the number Nt of the intervals is excessively large, the image forming apparatus 100 is liable to become too slow to react to the output of the toner amount detecting means 45, failing to timely adjusting the threshold toner supply amount t3 as the toner surface becomes higher then the level Hi or lower than the level Low. The value of the number Nt of the intervals does not need to be limited to 5, that is, the value used in this embodiment. However, the studies made by the inventors of the present invention revealed that it is preferable that the value of the number Nt of the intervals is in a range of 3-10 ($3 \leqq Nt \leqq 10$). Incidentally, in the case of an image forming apparatus which has virtually no lag between when the amount by which toner is to be supplied to the developer container 46 per toner hopper operation is adjusted, and when the amount of the toner in the developing apparatus 4 begins to reflect the adjusted amount, the value of the number Nt of the intervals may be one (Nt=1).

Figure 7:
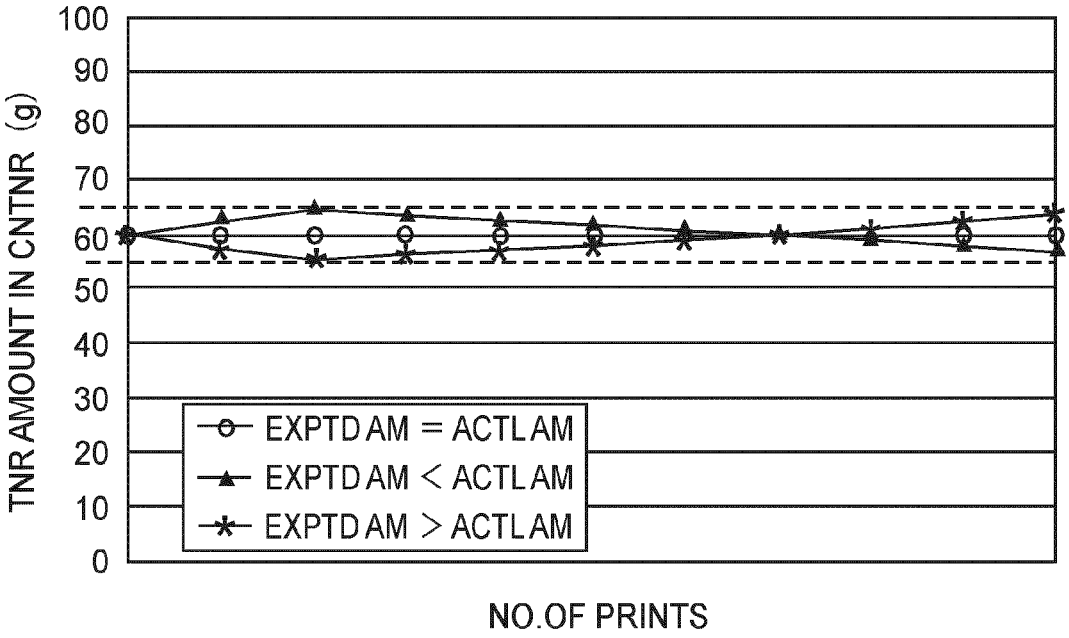
FIG. 7 is a graph showing the changes in the amount of the toner in the developer container, which occurred when the toner supply control sequence in accordance with the present invention was carried out.

FIG. 7 shows the changes in the amount of the toner in the developer container 46, which were detected by the duration tests of the image forming apparatus 100 in this embodiment.

Referring to FIG. 7, if the "estimated amount" by which toner will be supplied, equals the "actual amount" by which toner is supplied, the developing apparatus 4 is supplied with toner by the amount equal to the required amount, and therefore, the amount of the toner in the developing apparatus 4 does not change (remains more or less stable). In this embodiment, the "estimated amount" is equal to the threshold toner supply amount t3. Therefore, it may be said that the threshold toner supply amount t3 is equal to the "actual amount" by which toner is supplied.

If the "estimated amount" is smaller than "actual amount", the developing apparatus 4 is supplied with toner by an amount greater than the required amount, and therefore, the amount of the toner in the developer container 46 gradually increases. In this embodiment, however, the position of the toner surface is detected by the toner amount detecting means 45, and if the detected position of the toner surface is higher than the level Hi, the threshold toner supply amount t3 is increased. The greater the threshold toner supply amount t3, the less frequent the toner supplying operation. Thus, increasing the threshold toner supply amount t3 reduces the frequency with which toner is supplied to the developer container 46, gradually reducing the amount of the toner in the developer container 46.

If the "estimated amount" is greater than the "actual amount", the developing apparatus 4 is supplied with toner by an amount smaller than the required amount, and therefore, the amount of the toner in the developer container 46 gradually reduces. In this embodiment, however, the position of the toner surface is detected by the toner amount detecting means 45, and if the detected position of the toner surface is lower than the level Low, the threshold toner supply amount t3 is downwardly adjusted. The smaller the threshold toner supply amount t3, the more frequent the toner supplying operation. Thus, reducing the threshold toner supply amount t3 increases the frequency with which toner is supplied to the developer container 46, gradually increasing the amount of the toner in the developer container 46.

As described above, in this embodiment, the amount of the toner in the developer container 46 is detected by the toner amount detecting means 45, and the threshold toner supply amount t3 is adjusted according to the detected amount of the toner in the developer container 46. In other words, the detected (actual amount) of the toner in the developer container 46 is fed back to the adjustment of the threshold toner supply amount t3. Therefore, the threshold toner supply amount t3 gradually converges to the actual amount by which toner is supplied to the developer container 46 per toner hopper operation. Thus, even if the estimated amount by which toner will be supplied initially differs from the actual amount by which toner is supplied, the estimated amount eventually becomes the same as the actual amount by which toner is supplied. Thus, in practical terms, the image forming apparatus 100 can operate in the condition in which "estimated amount (threshold toner supply amount t3)" is equal to the "actual amount" (estimate amount=actual amount).

Carrying out the toner supply controlling operation in this embodiment makes the threshold toner supply amount t3 to settle to a value which is specific to each toner supplying apparatus and is very accurate, that is, virtually equal to the actual amount by which toner is supplied to the developer container 46. Therefore, in this embodiment, it does not occur that toner is supplied by an excessive or insufficient amount, and also, that toner is supplied too early or too late. That is, in this embodiment, it is always by the proper amount and with the proper timing that toner is supplied to the developer container 46. Further, this embodiment requires neither a complicated table for a toner supplying operation, nor a complicated control operation for adjusting the amount by which toner is supplied. In other words, this embodiment makes it possible to provide a toner supplying apparatus which is very simple in control sequence, as well as structure, being therefore highly reliable.

Further, in this embodiment, the amount by which toner is supplied per operation of the toner hopper 5 is fixed. Thus, the toner hopper 5 has only to be designed so that it is stable in the amount by which toner is supplied per toner supplying operation. In other words, this embodiment can contributes to the simplification of the toner hopper 5. Further, it makes unnecessary to use a complicated control sequence for compensating for the relationship between the length of time the toner hopper 5 is driven, and the estimated amount by which toner is discharged from the toner hopper 5.

Further, in this embodiment, the "estimated amount (threshold amount t3)" by which toner will be supplied, is made practically equal to the "actual amount" by which toner is supplied. Therefore, it may be said that the product obtained by multiplying the threshold amounts t3 by which toner is supplied per toner hopper rotation by the number of times the toner hopper 5 was operated, equals the cumulative amount of toner which were actually supplied by the toner hopper 5. Therefore, the amount of the toner remaining in the toner hopper 5 can be detected by comparing the amount by which toner hopper 5 was initially filled, with the products obtained by multiplying the threshold amounts t3 by the number of times the toner hopper 5 was operated, with the use of the CPU 35. In this case, the CPU 35 also functions as a residual replenishment toner amount detecting means for detecting the amount of the developer remaining in the developer supplying apparatus. Further, the CPU 35 may be provided with such a function that as the CPU 35 detects that the toner hopper 5 has run out of toner, it displays on a message displaying means, for example, the monitor or the like, with which the apparatus main assembly 11 is provided, or which is connected to the apparatus main assembly 11, a message indicating the depletion of the toner in the toner hopper 5. Further, in this embodiment, the threshold toner supply amount t3 is adjusted with a preset interval so that its value converges to the actual amount by which toner is supplied to the developer container 46. If this method is also used to detect the amount of the toner remaining in the toner hopper 5, it is possible to highly accurately detect the amount of the toner remaining in the toner hopper 5, with the use of a simple structural arrangement.

As described above, in this embodiment, the amount by which toner is to be supplied to the developing apparatus 4 is adjusted based on the actual amount by which toner was supplied to the developing apparatus 4 while an image forming apparatus to which the developing apparatus 4 belongs is actually in use. Therefore, the developing apparatus 4 is supplied with toner by a correct amount. That is, in this embodiment, it is possible to supply the developing apparatus 4 with toner at a high level of accuracy. Therefore, the developing apparatus 4 remains stable in the amount of the toner therein, being therefore stable in the amount of electric charge of the toner therein, preventing thereby the problem that an image suffering from the fog (phenomenon that toner adheres to areas of photosensitive drum, which are to be free of toner) attributable to the instability in the amount of toner charge, and/or an image which is nonuniform in density, is formed. In other words, this embodiment makes it possible for an image forming apparatus to form high quality images for a long time.

Embodiment 2

Next, another embodiment of the present invention will be described. The components, portions, etc., of the image forming apparatus in this embodiment, the function and structure of which are the same as, or similar to, those of the counterparts of the image forming apparatus in the first embodiment, will be given the same referential codes as those given to the counterparts, and will not be described in detail.

This embodiment is different from the first one in the following points: (1) The photosensitive drum, charge roller, cleaning apparatus, developing apparatus, etc., are integrated as a process cartridge, which is removably mountable in the main assembly of an image forming apparatus; and (2) The image forming apparatus in this embodiment is a full-color laser beam printer of the inline type.

Figure 8:
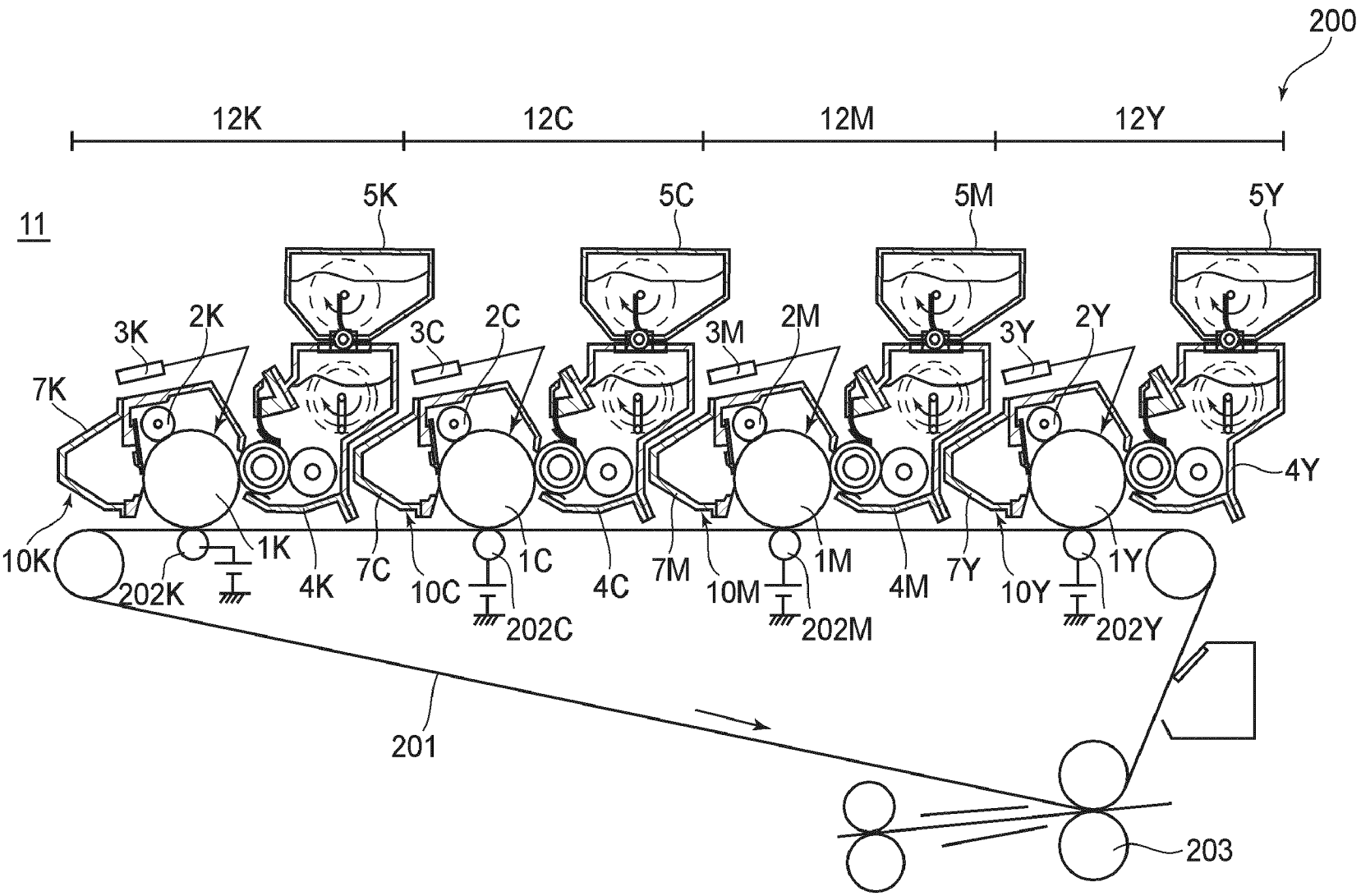
FIG. 8 is a schematic sectional view of the image forming apparatus in another embodiment of the present invention.
Figure 9:
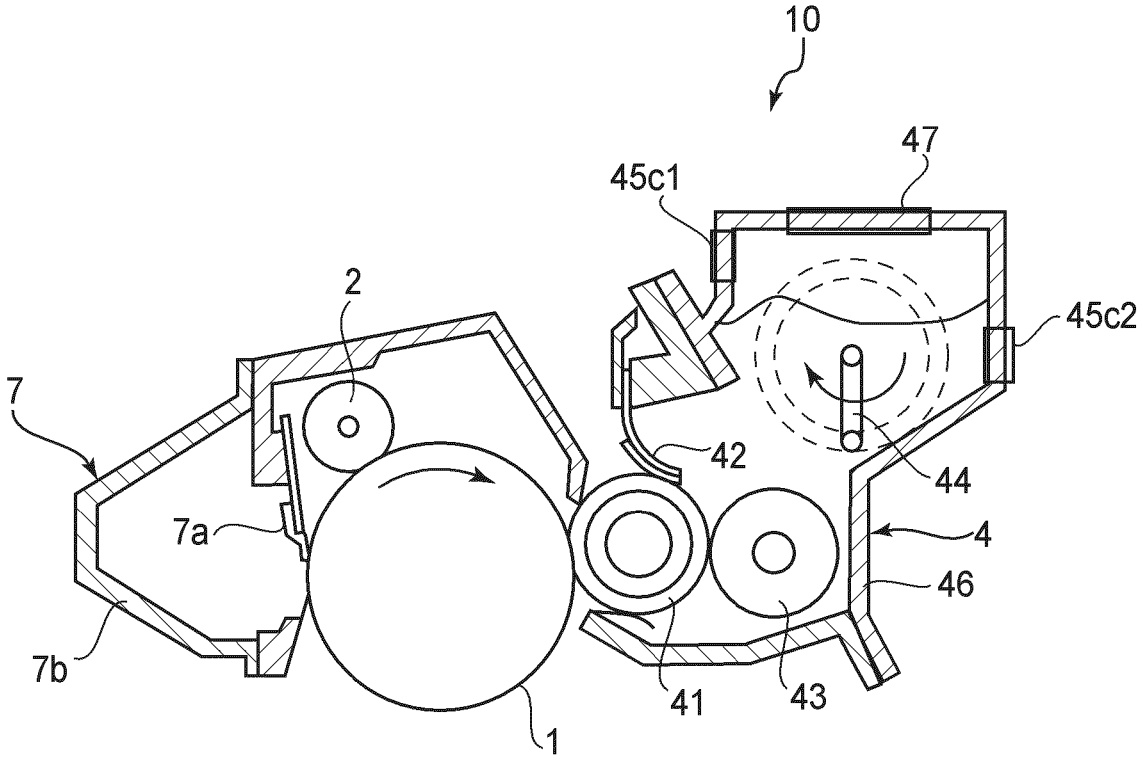
FIG. 9 is a schematic sectional view of an example of a process cartridge.

FIG. 8 is a schematic sectional view of the essential portions of the image forming apparatus 200 in this embodiment. FIG. 9 is a schematic sectional view of the process cartridge 10 employed by the image forming apparatus 200, and shows the general structure of the cartridge 10.

The image forming apparatus 200 in this embodiment has multiple image forming portions, more specifically, the first, second, third, and fourth image forming portions 12Y, 12M, 12C, and 12K, which forms yellow (Y), magenta (M), cyan (C), and black (K) images, respectively.

The image forming portions 12Y, 12M, 12C, and 12K are the same in structure and operation, although they are different in the color of the toner they use. Thus, unless it is necessary to differentiate the four image forming portions, the letters Y, M, C, and K given as the suffix for showing the color of the toner they use, will not be shown in the following description of this embodiment.

Each image forming portion 12 is provided with the photosensitive drum 1, charge roller 2, exposing apparatus 3, developing apparatus 4, and cleaning apparatus 7. The image forming apparatus 200 in this embodiment is provided with an intermediary transfer belt 201, which is an intermediary transferring member (second image bearing member). The intermediary transfer belt 201 is an endless belt, and can be circularly moved. The intermediary transfer belt 201 is positioned so that it faces the photosensitive drum 1 in each image forming portion. The image forming apparatus 200 is also provided with four transfer rollers 202, which are primary transferring means. The primary transfer rollers 202 are disposed in contact with the inward surface of the intermediary transfer belt 201, in terms of the loop which the intermediary transfer belt 201 forms, so that each of them opposes the corresponding photosensitive drum 1 in the corresponding image forming portion 12. Further, the image forming apparatus 200 is provided with: multiple rollers, around which the intermediary transfer belt 201 is stretched, being supported by them; and a secondary transfer roller 203, which is the secondary transferring means. The secondary transfer roller 203 is disposed so that it is in contact with the outward surface of the intermediary transfer belt 201 at a location where it opposes one of the abovementioned belt supporting multiple rollers.

The photosensitive drum 1, and the photosensitive drum processing means, that is, the charge roller 2, developing apparatus 4, and cleaning apparatus 7, are integrated as a process cartridge which is removably mountable in the apparatus main assembly 11.

As the process cartridge 10 reaches the end of its preset service life, it is removed and replaced. The process cartridge system makes it easier to replace a worn components or components, drastically improving an image forming apparatus in maintainability. Further, the structural components of an image forming apparatus, which are essential to an electrophotographic image forming method, can be replaced with brand-new components by replacing the process cartridge 10, making it possible to enable the image forming apparatus to continue to form high quality images.

The toner hoppers 5 in this embodiment are independent from the apparatus main assembly 11 and corresponding process cartridge 10, and are removably attached to the corresponding process cartridges 10, one for one.

The process cartridges 10Y, 10M, 10C, and 10K, which are removably mountable in the first to fourth image forming portions 12Y, 12M, 12C, and 12K, store the yellow (Y), magenta (M), cyan (C), and Black (K) toners, respectively. Further, the toner hoppers 5Y, 5M, 5C, and 5K, which are removably mountable in the first to fourth image forming portions, store the yellow (Y), magenta (M), cyan (C), and Black (K) replenishment toners, respectively.

For example, when the image forming apparatus 200 is in the full-color mode, the toner images formed on the peripheral surface of the photosensitive drums 1 in image forming portions 12, one for one, are sequentially transferred in layers (primary transfer) onto the intermediary transfer belt 201 by the function of the primary transfer rollers. For this transfer operation, the primary transfer bias voltage, the polarity of which is opposite to the normal polarity to which toner is charged, is applied to each of the primary transfer rollers 202.

After being transferred in layers onto the intermediary transfer belt 201, the color toner images are transferred together (secondary transfer) onto the transfer medium P by the function of the secondary transfer roller 203. For this transfer operation, the secondary transfer bias voltage, the polarity of which is opposite to the normal polarity to which toner is charged, is applied to the charge roller 203.

Thereafter, the transfer medium P is separated from the intermediary transfer belt 201, and then, is conveyed to a fixing apparatus (unshown), in which the toner images are fixed by being subjected to head and pressure. Then, the transfer medium P is discharged as a full-color print from the apparatus main assembly 11.

When a color print is made, multiple monochromatic toner images, which are different in color, are placed in layers on the transfer medium P. Thus, a color image forming apparatus is required to have high degree of resistance to image defects, such as fog (phenomenon that toner adheres to areas of peripheral surface of photosensitive drum (areas of transfer medium P), where toner is not to adhere), and nonuniformity in density. Therefore, a color image forming apparatus is required to more accurately control the toner supply to the developing apparatus 4. If the amount of toner in the developing apparatus 4 is unstable, the amount by which the toner in the developing apparatus 4 receives electric charge is unstable, which in turn results in the formation of an image which suffers from fog and/or is nonuniform in density. Thus, the toner supplying method in accordance with the present invention is also usable to supply multiple toners, different in color, to the developing apparatuses of a color image forming apparatus, such as the one in this embodiment, with very favorable results. Not only can the application of the present invention to a color image forming apparatus yield the same results as those described regarding the first embodiment, but also, contribute to the improvement of the color image forming apparatus in image quality.

Incidentally, a process cartridge system, such as the one in this embodiment described above, can be employed by the image forming apparatus 100 in the first embodiment.

Embodiment 3

Next, another preferred embodiment of the present invention will be described. The components, portions, etc., of the image forming apparatus in this embodiment, which are the same as, or equivalent to, the counterparts of the image forming apparatus in the first or second embodiment, in terms of function and structure, are given the same referential codes as those given in the first or second embodiment, one for one, and their descriptions will be skipped.

Figure 10:
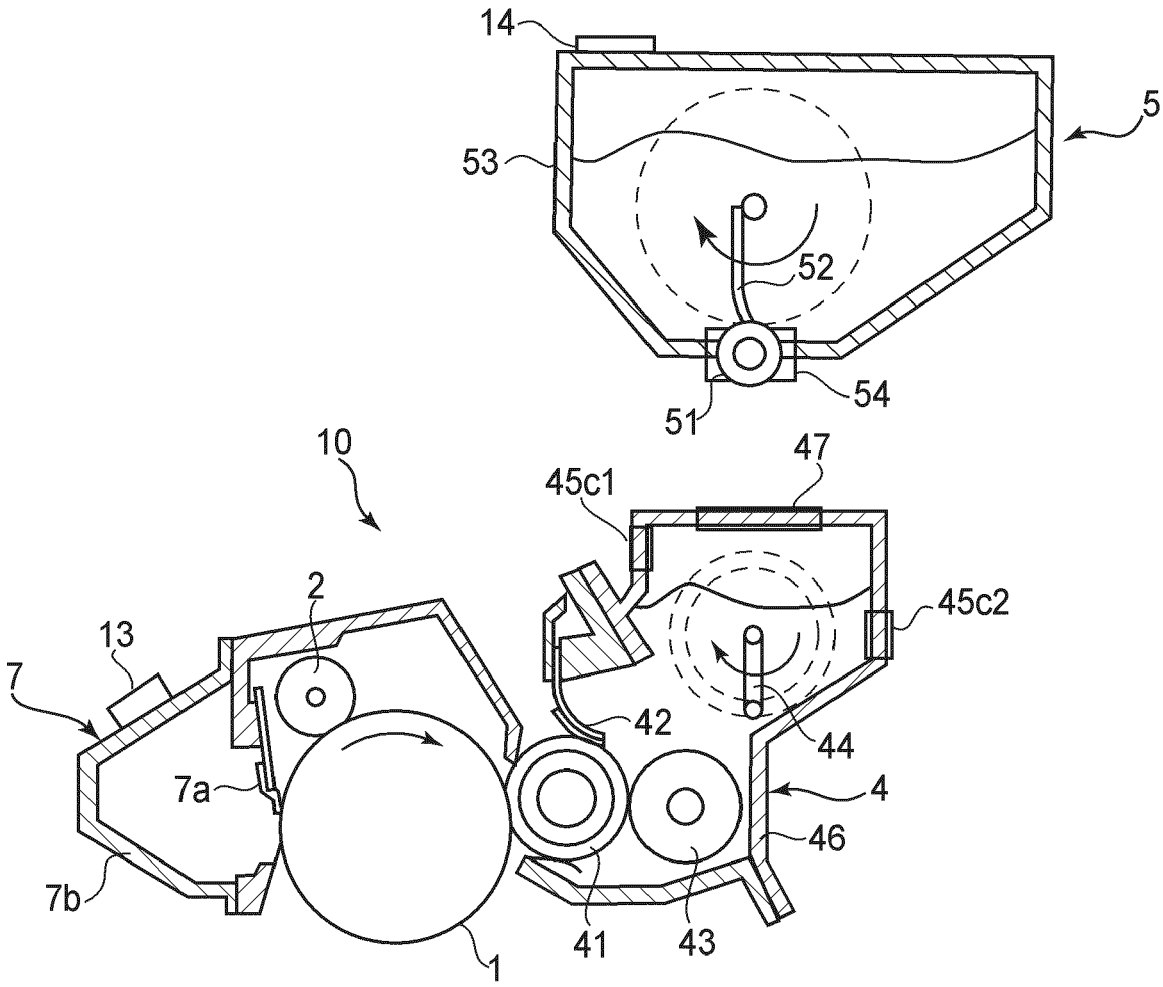
FIG. 10 is a schematic sectional view of the combination of another process cartridge and another toner hopper.

Referring to FIG. 10, the process cartridge 10 and toner hopper 5 (replenish toner cartridge), which are removably mountable in the apparatus main assembly 11, are provided with nonvolatile memories 13 and 14, respectively, which are information storing means. The image forming apparatus is structured so that as the process cartridge 10 or toner hopper 5 is mounted into the apparatus main assembly 11, various information can be exchanged between the CPU 35 of the apparatus main assembly 11 and the nonvolatile memories 13 and 14 to be read therefrom and/or written therein.

The nonvolatile memory 13 of the process cartridge 10 is made to store the cumulative amount t2 by which toner is to be supplied to the developing apparatus 4 of the process cartridge 10, whereas the nonvolatile memory 14 of the toner hopper 5 is made to store the newest threshold amount t3, and the value obtained by accumulating all the threshold amounts t3 for the toner supplying operations carried out by the toner hopper 5 since the threshold amount t3 was adjusted last time.

The timing with which the abovementioned information is read from, or written into, the nonvolatile memories 13 and 14 is as follows, for example: The information held by the CPU 35 is written into the nonvolatile memories 13 and 14 when the door of the apparatus main assembly 11, which is for mounting or removing the cartridge 10, is opened, or when the power source of the apparatus main assembly 11 is turned off, whereas the information held by the nonvolatile memories 13 and 14 is read by the CPU 35 when the abovementioned door is closed or the power source of the apparatus main assembly 11 is turned on. With the employment of this setup, the value of the cumulative amount t2, the value of the threshold amount t3, and the cumulative threshold amount t3, which are specific to each cartridge 10, become readily available.

As described regarding the first embodiment, after the threshold toner supply amount t3 is made to converge to a specific value by feedback, this value is specific to each toner supplying apparatus, and is extremely accurate. Thus, the value of the threshold toner supply amount t3 is stored as a specific value in the nonvolatile memory 14 of the toner hopper 5. Thus, even if the power source of the apparatus main assembly 11 is turned off or the toner hopper 5 is mounted in the apparatus main assembly 11, which is different from the apparatus main assembly 11 in which the toner hopper 5 was, the toner hopper 5 can supply the developing apparatus 4 with an optimal amount of tone, making the developing apparatus 4 more stable in the amount of toner therein, than a toner hopper (5) in accordance with the prior art. In other words, the present invention can improve an image forming apparatus in image quality.

Further, the value of the threshold toner supply amount amounts t3 is stored in the nonvolatile memory 14 of the toner hopper 5, and the amount of the toner remaining in the toner hopper 5 is calculated based ton the stored value. Therefore, even if the power source of the apparatus main assembly 11 is turned off, or the toner hopper 5 is mounted in the apparatus main assembly 11, which is different from the apparatus main assembly 11 in which the toner hopper 5 was, the information regarding the amount of the toner remaining in each toner hopper 5 is possessed by the toner hopper 5 itself. Therefore, even in a case where the amount of the remaining in the toner hopper 5 is calculated by counting the cumulative length of time the toner hopper 5 is driven, the amount can be calculated at a significantly higher level of accuracy. Therefore, the amount of the toner remaining in the toner hopper 5 can be always accurately calculated.

Further, the cumulative amount t2 by which toner is to be supplied is stored in the nonvolatile memory 13 of the process cartridge 10. In other words, the information regarding the amount of the toner in the process cartridge 10 is possessed by the process cartridge 10 itself. Therefore, even if the power source of the apparatus main assembly 11 is turned off, or the process cartridge 10 is mounted into the apparatus main assembly 11, which is different from the apparatus main assembly 11 in which the process cartridge 10 was, it does not occur that the developing apparatus 4 of the process cartridge 10 fails to be supplied with toner. Therefore, the developing apparatus 4 remains more stable in the amount of toner therein, than a toner hopper (5) in accordance with the prior art. In other words, the present invention can improve an image forming apparatus in image quality.

In the above, the present invention was described with reference to the preferred embodiments of the present invention. However, it should be understood that the preceding embodiments are not intended to limit the present invention is scope.

For example, the electrostatic image forming apparatus to which the present invention is applicable also includes a copying machine, a printer (for example, LED printer, laser printer, etc.), a facsimile apparatus, a wordprocessor, etc.

A process cartridge means a cartridge in which a charging means, a developing means (or cleaning means), and an electrophotographic photosensitive member are integrally disposed, and which is removably mountable in the main assembly of an image forming apparatus. It also means a cartridge in which at leans one among a charging means, a developing means, and a cleaning means, and an electrophotographic photosensitive member, are integrally disposed, and which is removably mountable in the main assembly of an image forming apparatus, or a cartridge in which at least a developing apparatus and an electrophotographic photosensitive member are integrally disposed, and which is removably mountable in the main assembly of an image forming apparatus.

A cartridge which is removably mountable in the main assembly of an image forming apparatus is not a process cartridge alone. For example, a developing means may be turned into a development cartridge by placing it in a cartridge which is removably mountable in the main assembly of an image forming apparatus.

Figure 11:
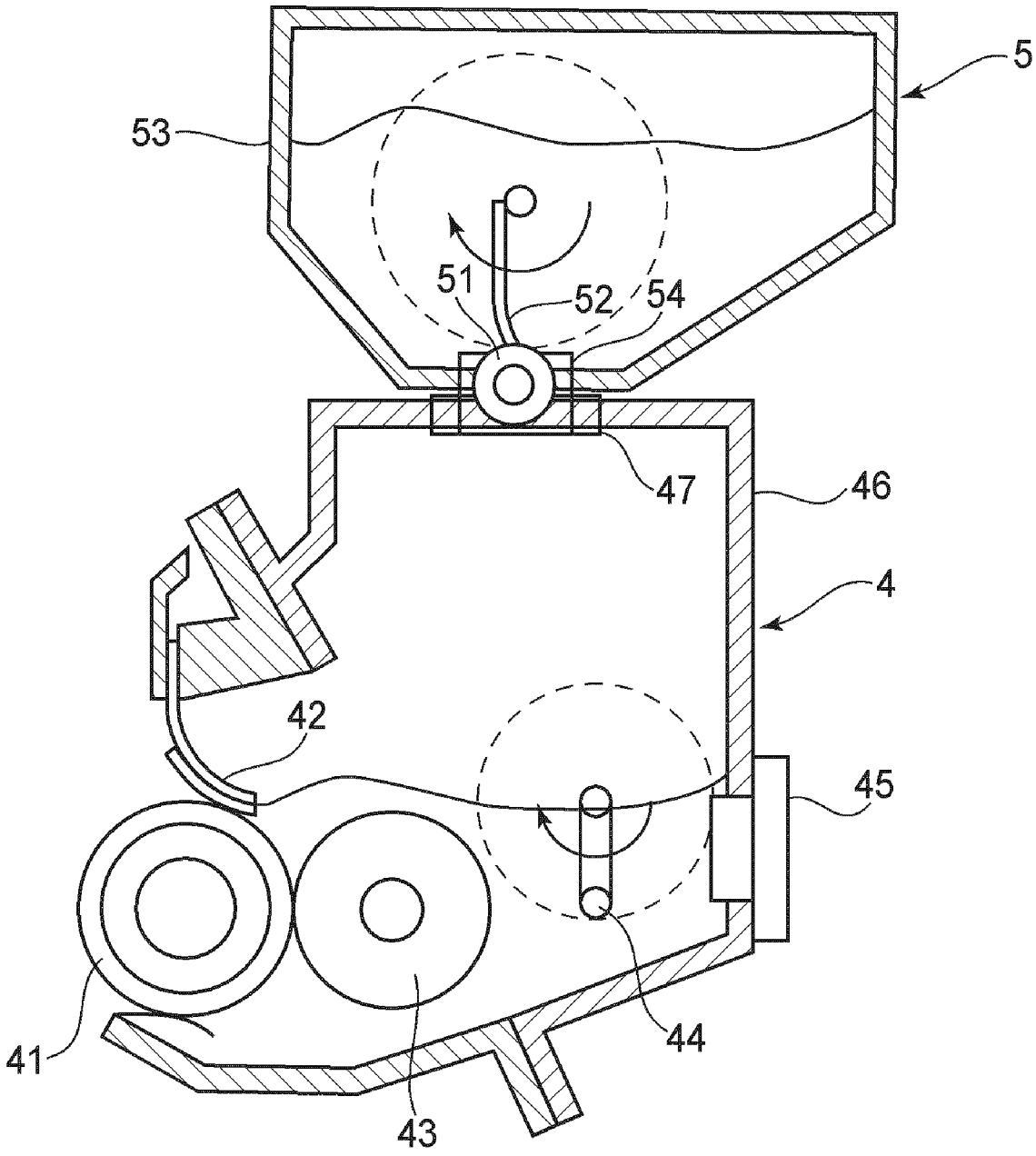
FIG. 11 is a schematic sectional view of another combination of a developing apparatus and a toner hopper, which is for describing another example of a toner amount detecting means.
Figure 12:
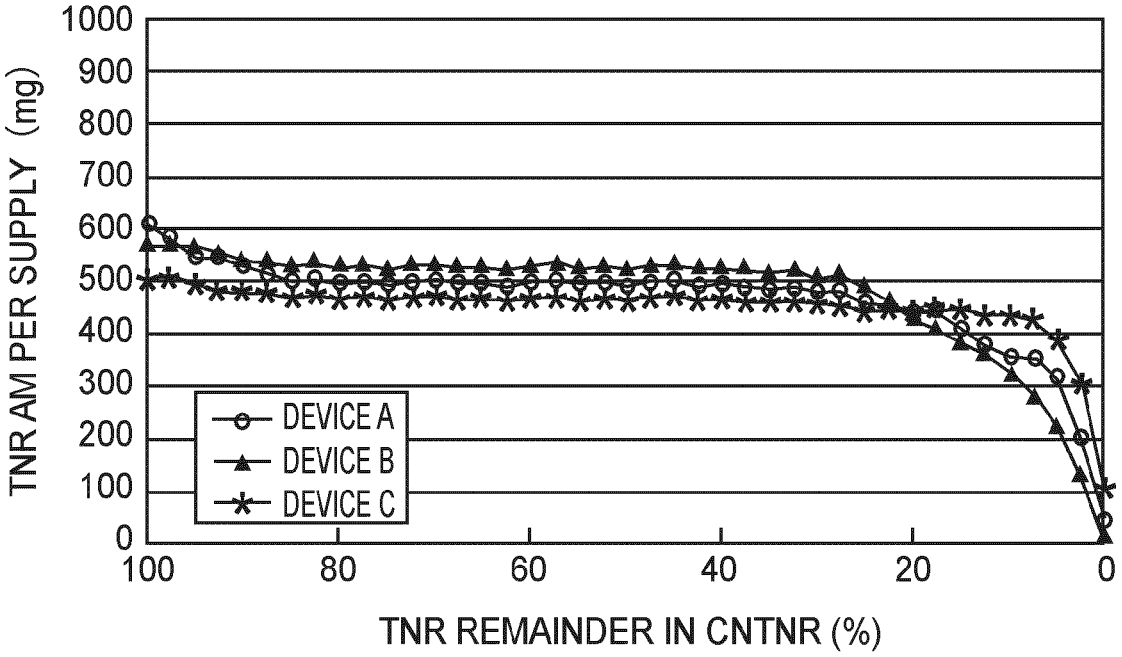
FIG. 12 is a graph showing the changes in the amount by which toner was delivered to the toner hopper, which occurred when the toner supply control sequence in accordance with the prior art was carried out.
Figure 13:
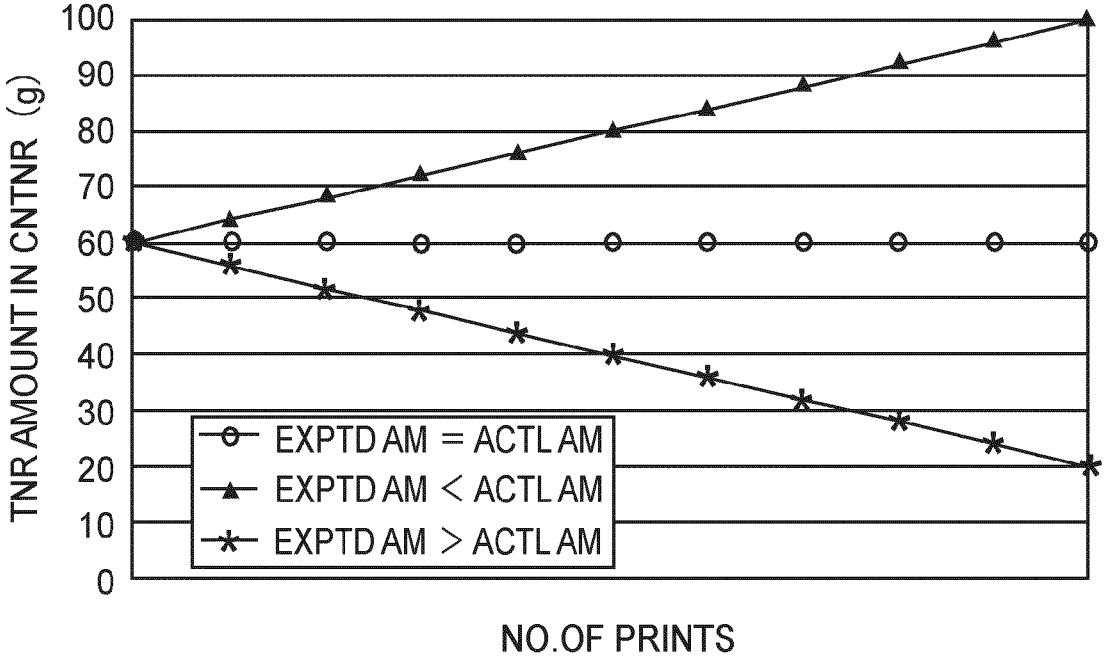
FIG. 13 is a graph showing an example of the changes in the amount of the toner in the developer container, which occurred when the toner supply control in accordance with the prior art was carried out.

In the preferred embodiments of the present invention described above, the toner amount detecting means 45 was an optical means. However, the preferred embodiments are not intended to limit the application of the present invention to a toner supplying apparatus having an optical toner amount detecting means. That is, the toner amount detecting means may be a piezoelectric, as shown in FIG. 11, which is disposed as a toner amount detecting means (45) in the adjacencies of the rotatable stirring paddle 44, which is the means for conveying the toner in the developer container 46 while stirring the toner.

Also in the preferred embodiments, the developer supplying member of the toner hopper 5 was in the form of a roller. However, the developer supplying member may be in the form of a screw.

Further, the present invention is also applicable to a developing apparatus which uses two-component developer, that is, primarily a mixture of nonmagnetic particulate toner and magnetic particulate carrier. In such a case, the replenishment developer may be toner alone, or a mixture of toner and carrier.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 2007-223281 (Pat.) and 2008-214709 (Pat.) filed Aug. 29, 2007 and Aug. 22, 2008, respectively which are hereby incorporated by reference.

What is claimed is:

1. An image forming apparatus comprising:

a developing device for developing an electrostatic image with a developer;

a developer amount detecting device for detecting amounts of a developer in said developing device;

a developer consumption amount calculating device for calculating a consumption amount of the developer on the basis of image information of the electrostatic image;

a developer supplying device for carrying out a developer supplying operation to supply the developer to said developing device; and a control device for controlling the developer supplying operation to said developing device by said developer supplying device, wherein said control device controls said developer supplying device to supply a predetermined amount of the developer every time an integrated value of the consumption amount of the developer exceeds a supply threshold, and corrects the supply threshold on the basis of an average of the developer amounts in said developing device detected by said developer amount detecting device in a predetermined period.

2. An image forming apparatus comprising:

a developing device for developing an electrostatic image with a developer;

a developer amount detecting device for detecting an amount of a developer in said developing device;

a developer consumption amount calculating device for calculating a consumption amount of the developer on the basis of image information of the electrostatic image;

a developer supplying device for carrying out a developer supplying operation to supply the developer to said developing device; and a control device for controlling the developer supplying operation to said developing device by said developer supplying device, wherein said control device controls said developer supplying device to supply a predetermined amount of the developer every time an integrated value of the consumption amount of the developer exceeds a supply threshold, and corrects the supply threshold on the basis of information relating to an amount of the developer in said developing device detected by said developer amount detecting device, and wherein said control device defers correcting the supply threshold until a predetermined number of the developer supplying operations have been performed.

3. An image forming apparatus comprising:

a developing device for developing an electrostatic image with a developer;

a developer amount detecting device for detecting amounts of a developer in said developing device;

a developer consumption amount calculating device for calculating a consumption amount of the developer on the basis of image information of the electrostatic image;

a developer supplying device for carrying out a developer supplying operation to supply the developer to said developing device; and a control device for controlling the developer supplying operation to said developing device by said developer supplying device, wherein said control device controls said developer supplying device to supply a predetermined amount of the developer every time an integrated value of the consumption amount of the developer exceeds a supply threshold, and corrects the supply threshold on the basis of information relating to an amount of the developer in said developing device detected by said developer amount detecting device, wherein said developer supplying device includes a rotatable developer supplying member for supplying the developer to said developing device by rotation thereof, and wherein a number of rotations of said rotatable developer supplying member per unit developer supplying operation of said developer supplying device in an integer.

4. An image forming apparatus according to claim 3, wherein said developer consumption amount calculating device includes a video counting device for calculating a video count, and wherein the image information of the electrostatic image is the calculated video count.

5. An image forming apparatus according to claim 3, wherein said developer consumption amount calculating device includes a print ratio calculating device for calculating a print ratio, and wherein the image information of the electrostatic image is the print ratio calculated by said print ratio calculating device.

6. An image forming apparatus according to claim 3, wherein when said developer supplying device effects the developer supplying operation, the supply threshold used for comparison with the integrated value of the consumption amount of the developer at the time of the developer supplying operation is subtracted from the integrated value of the consumption amount of the developer.

7. An image forming apparatus according to claim 3, wherein every time said developer supplying device effects the developer supplying operation, the supply threshold used for comparison with the integrated value of the consumption amount of the developer at the time of the developer supplying operation is integrated, and the remaining amount of the developer in said developer supplying device is detected on the basis of an integrated value of the supply threshold.

8. An image forming apparatus according to claim 7, wherein said developer supplying device is detachably mountable to a main assembly of said image forming apparatus, wherein said developer supplying device includes a storing device, and wherein the integrated value of the supply threshold is stored in the storing device provided in said developer supplying device.

9. An image forming apparatus according to claim 3, wherein said developing device is detachably mountable relative to a main assembly of said image forming apparatus, wherein said developing device includes a storing device, and wherein the integrated value of the consumption amount of the developer is stored in the storing device provided in said developing device.

10. An image forming apparatus according to claim 3, wherein said developer supplying device is detachably mountable to a main assembly of said image forming apparatus, wherein said developer supplying device includes a storing device, and wherein the supply threshold is stored in the storing device provided in said developer supplying device.

11. An image forming apparatus according to claim 3, wherein the developer used by said developing device is a one-component developer.

12. An image forming apparatus according to claim 3, wherein said developer amount detecting device is a light detecting type device.

* * * * *

UNITED STATES PATENT AND TRADEMARK OFFICE

CERTIFICATE OF CORRECTION

PATENT NO. : 7,881,623 B2
APPLICATION NO. : 12/200152
DATED : February 1, 2011
INVENTOR(S) : Seiji Yamaguchi It is certified that error appears in the above-identified patent and that said Letters Patent is hereby corrected as shown below:

Title Page, [57] Abstract, line 9, delete "supply" and insert therefor --supplying--; and
Line 11, delete "supply" and insert therefor --supplying--.

In Column 13, line 39, delete "supply" and insert therefor --supplying--.

In Column 24, line 33, delete "in" and insert therefor --is--.

Signed and Sealed this
Twenty-sixth Day of April, 2011

David J. Kappos

David J. Kappos
*Director of the United States Patent and Trademark Office*